US008905254B2

(12) United States Patent
Joubert

(10) Patent No.: US 8,905,254 B2
(45) Date of Patent: Dec. 9, 2014

(54) TRANSPORT OF GOODS

(75) Inventor: Simon John Joubert, Port Elizabeth (ZA)

(73) Assignee: Mechana CC, Sidwell (ZA)

( * ) Notice: Subject to any disclaimer, the term of this patent is extended or adjusted under 35 U.S.C. 154(b) by 30 days.

(21) Appl. No.: 13/000,620

(22) PCT Filed: Jun. 23, 2009

(86) PCT No.: PCT/IB2009/052689
§ 371 (c)(1),
(2), (4) Date: Jun. 8, 2011

(87) PCT Pub. No.: WO2009/156945
PCT Pub. Date: Dec. 30, 2009

(65) Prior Publication Data

US 2011/0186568 A1 Aug. 4, 2011

(30) Foreign Application Priority Data

Jun. 23, 2008 (ZA) ..... 08/5471

(51) Int. Cl.
*B65D 88/00* (2006.01)
*B65D 19/12* (2006.01)

(52) U.S. Cl.
CPC ..... *B65D 19/12* (2013.01); *B65D 2519/00925* (2013.01); *B65D 2519/00532* (2013.01);
(Continued)

(58) Field of Classification Search
CPC ..... B65D 2519/00601; B65D 2519/00885; B65D 2519/000925; B65D 2519/00656
USPC ..... 211/170, 189, 149, 165; 220/4.33, 4.28, 220/7, 6, 1.5, 666, 668; 206/600, 386, 507, 206/505; 217/45, 43 A, 43 R, 36, 14; D9/421, 433; 312/262
See application file for complete search history.

(56) References Cited

U.S. PATENT DOCUMENTS 578,445 A * 3/1897 Cobleigh ..... 217/14
669,631 A * 3/1901 Gillette ..... 217/47
(Continued)

FOREIGN PATENT DOCUMENTS

DE 4445678 4/1996
DE 4208614 9/1996
(Continued)

OTHER PUBLICATIONS

International Search Report issued in PCT Application No. PCT/IB2009/052689, mailed Sep. 30, 2009, 5 pages.
(Continued)

*Primary Examiner* — Andrew Perreault
*Assistant Examiner* — James M Van Buskirk
(74) *Attorney, Agent, or Firm* — Klarquist Sparkman, LLP

(57) ABSTRACT

The invention provides a container which has an erect condition in which it defines a load space within which goods to be transported are receivable and a collapsed condition. The container is configured such that a plurality of like containers, when in their collapsed condition, are receivable in the container for transport together therewith. The container includes a pair of ends, at least one and preferably two sides, which, in the erect condition of the container extend between the ends and a base. The ends, the or each side and the base may be formed of elongate elements. Alternatively, the ends, sides and base may be clad such that the load space is partially or fully enclosed.

17 Claims, 27 Drawing Sheets

(52) U.S. Cl.

CPC ..... *B65D 2519/00656* (2013.01); *B65D 2519/00024* (2013.01); *B65D 2519/00233* (2013.01); *B65D 2519/00333* (2013.01); *B65D 2519/00805* (2013.01); *B65D 2519/00502* (2013.01); *B65D 2519/00164* (2013.01); *B65D 2519/00273* (2013.01); *B65D 2519/0082* (2013.01); *B65D 2519/00731* (2013.01); *B65D 2519/00691* (2013.01); *B65D 2519/00059* (2013.01); *B65D 2519/00323* (2013.01); *B65D 2519/00293* (2013.01); *B65D 2519/00815* (2013.01); *B65D 2519/00661* (2013.01); *B65D 2519/00935* (2013.01); *B65D 2519/00338* (2013.01); *B65D 2519/00606* (2013.01); *B65D 2519/00696* (2013.01)

USPC ..... 220/1.5; 220/4.33; 220/4.28; 220/6; 220/7; 211/170; 211/189; 211/149; 206/600; 206/386

(56) References Cited

U.S. PATENT DOCUMENTS

| | | | | | |
|---|---|---|---|---|---|
| 1,218,920 | A | * | 3/1917 | Averill | 294/68.21 |
| 2,071,228 | A | * | 2/1937 | Gehret | 217/14 |
| 2,456,419 | A | * | 12/1948 | Jackson et al. | 220/6 |
| 2,780,382 | A | * | 2/1957 | Beckner et al. | 220/6 |
| 3,645,596 | A | * | 2/1972 | Russell-French | 312/258 |
| 3,877,602 | A | * | 4/1975 | Clark et al. | 220/4.28 |
| 3,949,929 | A | | 4/1976 | Kupersmit | |
| 4,186,841 | A | | 2/1980 | Buckley et al. | |
| 4,240,555 | A | * | 12/1980 | Jurasek | 206/511 |
| 4,591,065 | A | | 5/1986 | Foy | |
| 4,662,532 | A | | 5/1987 | Anderson et al. | |
| 5,145,311 | A | | 9/1992 | Salvucci | |
| 5,507,237 | A | | 4/1996 | Barrow et al. | |
| 5,904,262 | A | * | 5/1999 | Coppi | 220/7 |
| 6,092,687 | A | * | 7/2000 | Hupp et al. | 220/666 |
| 6,305,566 | B1 | * | 10/2001 | Pigott et al. | 220/6 |
| 7,270,236 | B2 | * | 9/2007 | Angeletti et al. | 206/448 |
| 8,210,734 | B2 | * | 7/2012 | Wu | 362/647 |
| 2011/0192760 | A1 | | 8/2011 | Joubert | |

FOREIGN PATENT DOCUMENTS

| | | |
|---|---|---|
| DE | 2020080107945 | 9/2008 |
| EP | 0048577 | 3/1982 |
| EP | 1574444 | 9/2005 |
| FR | 1593223 | 5/1970 |
| FR | 2079992 | 11/1971 |
| FR | 2751618 | 1/1998 |
| GB | 1299219 | 12/1972 |

OTHER PUBLICATIONS

Written Opinion issued in PCT Application No. PCT/IB2009/052689, Sep. 29, 2009, 7 pages.

International Preliminary Report on Patentability, issued in PCT Application No. PCT/IB2009/052689, mailed Sep. 6, 2010, 6 pages.

International Preliminary Report on Patentability (Chapter 1 of the Patent Cooperation Treaty) issued in PCT Application No. PCT/IB2009/054440, Apr. 12, 2011, 7 pages.

* cited by examiner

TRANSPORT OF GOODS

CROSS REFERENCE TO RELATED APPLICATIONS

This is the U.S. National Stage of International Application No. PCT/IB2009/052689, filed Jun. 23, 2009, which was published in English under PCT Article 21(2), which in turn claims the benefit of South Africa Application No. 2008/05471, filed Jun. 23, 2008, both of which are incorporated herein by reference in their entirety.

FIELD

Background

The Inventor is aware of containers for the transport of goods which define a load space in which the geode are receivable. The problem with these containers is that after the transport of the geode to a desired destination the containers are costly to return to the point of departure, and are often destroyed at their destination, also at a cost and at the expense of natural resources. The inventor believes that it would be advantageous to provide a container which addresses at least some of these problems.

DE 4208614. EP-A-1574444, US-A3,949,929. FR-A-2079992, GB-A-1299219 and FR-A1593223 all disclose container having a base end side walls extending the length and width of the container With the side walls extending upwardly from the container such that the outer surfaces of the side walls extending flush with the outer edges of the base. As a result, the load space defined by the container is reduced in its length and width of the base. Accordingly, even if the container is displaces to a more compact collapsed condition, the base of one container is simply not receivable within the load space of another container because it has physically larger dimensions.

In the maturity of these cases when the containers are displaced to a collapsed condition, they are simply stackable one on top of the other. In EP 1574444 the side walls are made up of two generally U-shaped segments comprising a central section to which end sections are hingedly connectable for displacement between their erect and collapsed conditions. The side walls, when in their collapsed condition, are receivable in a container in its erect condition. However, the base of a container defines the maximum width and depth thereof, the side walls extending upwardly therefrom defining a load space which has reduced dimensions when compared with the dimensions of the base. Accordingly, the base is not receivable within the load space of the erect container thereby necessitating separation of the side walls from the base when being transported in the collapsed condition. This naturally increases the risk that part of the container may be misplaced rendering the container useless.

SUMMARY

According to the aspect of the invention there is provided a container which has an erect condition in which it defines a load space within which goods to be transported ere receivable and a collapsed condition, a plurality of like containers being transportable, when in their collapsed condition in the container.

In one embodiment of the invention when in their collapsed condition a plurality of the containers is at least partially receivable in the load space of a said container when said container is in its erect condition.

The container may include a pair of ends which, in the erect condition of the container are parallel and at least one side, which, in the erect condition of the container extends between the ends.

In one embodiment of the invention, the container may include a pair of sides which in the erect condition of the container are parallel and extend between the ends.

The container may include a base, at least part or the base may be hingedly connected to the at least one side and releasably connectable to the ends and/or the other side.

The load space may be generally parallelepiped. In particular it may be rectangular. In this regard, it will be appreciated that the horizontal length of the load space of an erect container may be at least equal to the horizontal length of a container in the collapsed condition, thereby to permit, in use, a container in the collapsed condition to be receivable therein. Further, the depth of the load space may be at least equal to the height of the container in the collapsed condition. Preferably, the depth of the load space may be greater than the height of the container in the collapsed condition such that the collapsed containers are contained entirely within the load space.

In another embodiment the container may have a partially collapsed condition in which it defines a container receiving space within which a plurality of like containers is at least partially receivable and transportable when in their collapsed condition. The container may include a pair of sides which in the erect condition of the container are generally parallel and a pair of ends which in the erect condition of the container are parallel and generally perpendicular to the sides, the ends being hingedly connected to one of the sides at or adjacent opposed ends thereof and disconnectably connectable from the other side for displacement inwardly from their erect condition to their collapsed condition, in which they extend generally parallel at said one side and in which they are releasably lockable.

The base may be hingedly connected to said one of the sides and releasably lockable with the ends and/or the other side.

The other side may be displaceable to and releasably lockable in a collapsed condition in which it is in abutment with or closely spaced from the one side.

Each of the sides, ends and base may be in the form of a frame comprising a plurality of frame members. At least some of the frames may be provided with cladding such that the load space is partially or fully enclosed.

The one side may include elongate parallel top and bottom members and parallel connecting members connected to and extending between the top and bottom members.

The other side may include an elongate top member and parallel elongate vertical members which are connected to the top member and, when the container is in its erect condition, the top member is disconnectably connected to the ends, and the vertical members are disconnectably connected to the base.

Instead, the other side may include elongate top and bottom members and parallel connecting members which are connected to the top member and disconnectably connected to the bottom member, the top and bottom members being disconnectably connected at opposed ends thereof to the ends.

In another embodiment of the invention, the other side may include an elongate top member, parallel with and hingedly connected to an elongate centre member via rigidised cladding or parallel elongate vertical members which are fixed to and extend downwardly from the top member generally perpendicular thereto. The centre member may be hingedly connected to the base via parallel elongate vertical members which are fixed to and extend downwardly from the centre member, generally perpendicular thereto. It will be appreciated that the top and centre members of the other side may be disconnectably connected to the ends.

The base may include an elongate horizontal cross member and at least one bracing member which extends between and is hingedly connected to the horizontal cross member and the bottom member of the one side at respective ends thereof. The bracing member may be connected to the horizontal cross member via a hinged linkage typically in the form of a rectangular plate. Preferably two parallel spaced apart bracing members are connected to the cross member and the bottom member of the one side. Instead, the container may include at least one bracing member which extends between and is hingedly connected to the bottom members of the sides. Preferably two parallel spaced apart bracing members are connected to the bottom members. The bracing members may be configured, in the erect condition of the container, to be engageable by the tines or prongs of a fork lift. Instead, or in addition, the horizontal cross member may define locating means to be engageable by the tines or prongs of a fork lift. Instead, or in addition, the bottom member of the one side may define the locating means.

Each of the ends may include a pair of elongate parallel side members and parallel top and bottom members connected to and extending between the side members, one of the side members of each of the ends being hingedly connected to the top and bottom members of the one side. The other side member may be disconnectably connected to the top and centre member of the other side, and to the cross member of the base. The lengths of the ends, i.e. the length of the top and/or bottom members as well as the width of the side members, may not be greater than half the length of any of the top/bottom members of the one/other side. Preferably, the length of each end is equal to a length measured from the end of the top member of the other side to the vertical member thereof. It will be understood that in other embodiments of the invention, the length of each end is equal to a length measured from the end of the top member of either side to the vertical member thereof.

The container may include a mounting or bracing arrangement configured to secure goods within the load space and thereby prevent unnecessary movement thereof. The mounting arrangement may be collapsible such that, in use when the container is in the collapsed condition, the mounting arrangement may have a collapsible condition receivable or nestable with the container in the collapsed condition. In this regard it will be appreciated that, in use when the container is in the erect condition, the mounting arrangement may have an erect condition thereby to secure goods therein within the load space.

The container may be constructed of steel.

According to another aspect of the invention there is provided a method of transporting containers which are displaceable between an erect condition and a collapsed condition which includes the steps of:

displacing at least one container into its collapsed condition; and transporting the collapsed container in another one of the containers.

In one embodiment of the invention, in its erect condition said other one of the containers defines a load space, the method including positioning the or each collapsed container at least partially in the load space.

In another embodiment of the invention the method includes displacing said other one of the containers to a partially collapsed condition in which it defines a container receiving space and positioning the or each collapsed container at least partially in the container receiving space.

The invention extends to a collapsible container having a first volume within which a plurality of collapsed like containers is transportable, each collapsed like container having a second volume not exceeding the first volume.

The invention extends further to a collapsible container within which a plurality of collapsed like containers is transportable.

The container may be displaceable between an erect condition and a collapsed condition.

The plurality of like containers may be transportable within a partially collapsed collapsible container.

The container may include a pair of sides, a pair of ends, a base and a lid hingedly connected to one of the sides such that it is pivotally foldable relative to the one side. In particular the lid may be hingedly connected to a elongate top member of the one side. The lid may also be hinged along an axis parallel to the top member of the one side.

The base may be pivotally foldable to the one side. In particular, the base may be foldable concertina-fashion to the one side. In this regard, the base may be hingedly connected to a bottom member of the one side and may also be hinged along an axis parallel to the bottom member of the one side. In one particular embodiment of the invention, the base is connected to the other side such that the other side is displaceable to a position adjacent the one side when the base is folded in use. The other side may therefore be releaseably attachable or attached to the ends.

In its partially erect condition one of the sides may be displaced relative to the ends and a like collapsed container may be attachable to the ends of the container in place of said one side thereby to define an enclosure for receiving a plurality of collapsed like containers.

The ends may include elevated support formations adjacent feet thereof so as to provide a support or support surface for like collapsed containers packed in an erect or partly erect container. Instead, or in addition, the sides may include the support formations.

In one embodiment of the invention, the sides, ends, base and lid may be constructed of sheet-like material such as sheet metal, plastics or the like such that the container forms a box-like structure when in the erect condition. The sides, ends, base and lid may be constructed of injection moulded plastics, or the like.

The invention also extends to a collapsible container having an erect condition wherein a plurality of collapsed containers is receivable for transport, the container including elevated support formations provided adjacent feet of sides or ends of the container for providing support for collapsed like containers receivable in the erect container.

Further aspects of the invention will become apparent by way of example with reference to the accompanying diagrammatic drawings.

DETAILED DESCRIPTION

Figure 1:
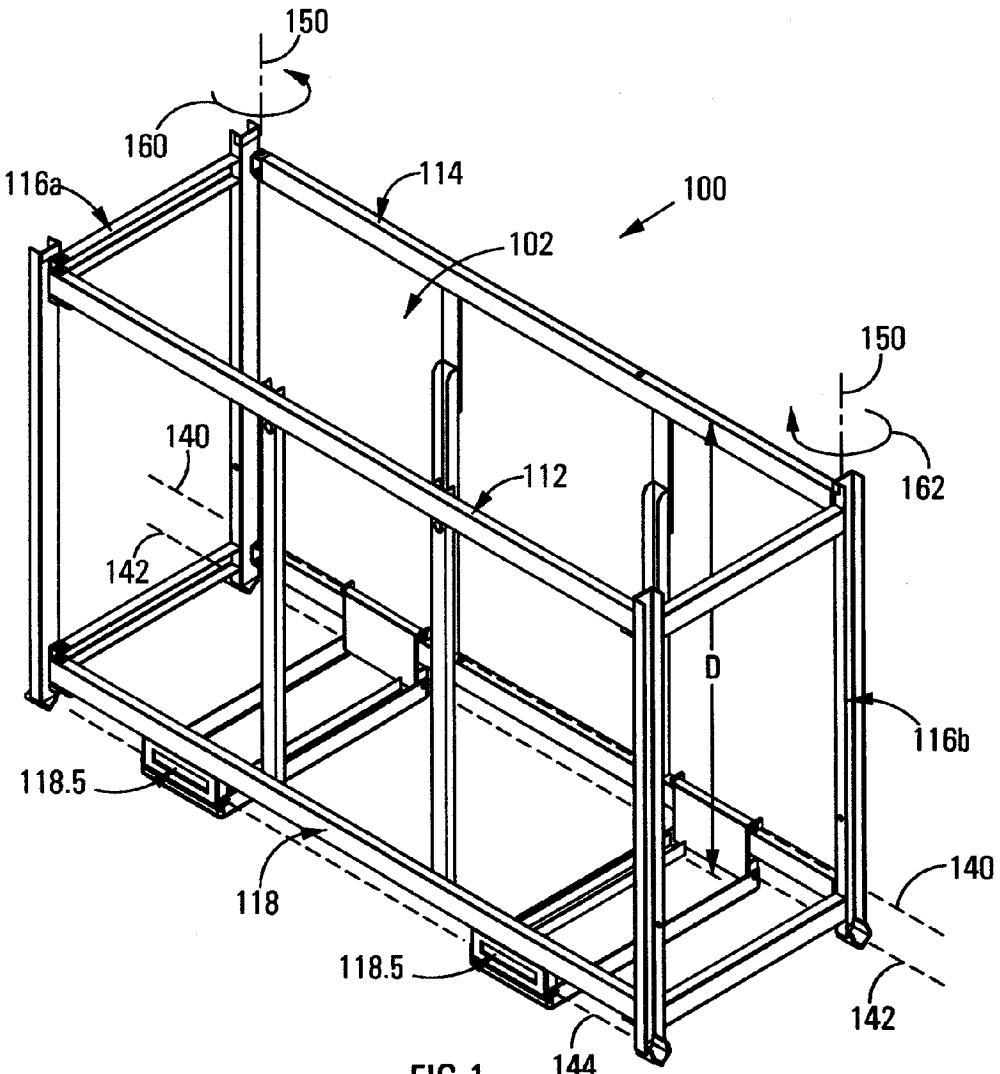
FIG. 1 shows a three-dimensional view of a container, in accordance with the invention, in an erect condition.

Referring to the FIG. 1 of the drawings, a container in accordance with the invention is generally referred to by reference numeral 100. It will be noted that FIG. 1 shows the container 100 in an erect condition. The container 100 is in the form of a crate with a plurality of frames which make up the crate. In particular, the container 100 includes a pair of sides which are parallel viz. a front side 112 and a rear side 114. The container 100 also includes a pair of ends 116*a*, 116*b* which are parallel and generally perpendicular to the front side 112 and the rear side 114 thereby defining a generally rectangular load space 102. The ends 116 are hingedly connected to the rear side 114 and are disconnectably connectable to the front side 112. The container 100 also includes a base 118, the base 118 being hingedly connected to the rear side 114 and disconnectably connectable to the front side 112.

Figure 2:
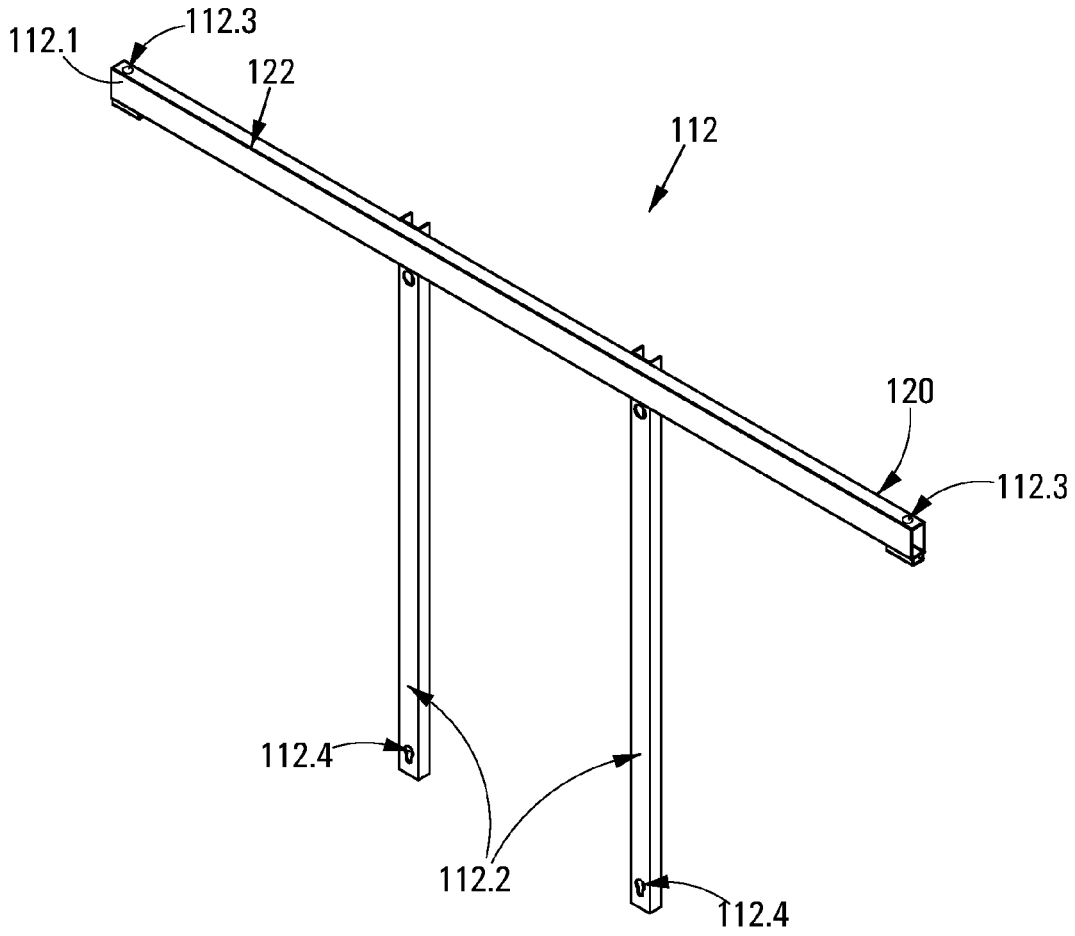
FIG. 2 shows a three-dimensional view of a front side of the container of FIG. 1.

Referring to FIG. 2 of the drawings, the front side 112 includes an elongate tubular horizontal top member 112.1 of generally rectangular section, and a pair of parallel elongate vertical members 112.2 attached at their upper ends to the top member 112.1 and extending downwardly therefrom when the container is in its erect condition. The vertical members 112.2 are channel-like members, of general U-shaped section, which are attached to a rear surface 120 of the horizontal top member 112.1 such that the vertical members 112.2 are disposed rearwardly from the rear surface 120 and their upper ends are flush with an upper surface 122 of the horizontal top member 112.1. In this particular embodiment of the invention, each vertical member 112.2 has an aperture 112.4 for receiving a hook (not shown), or the like of the base 118 thereby to secure the front side 112 to the base 118. The aperture 112.4 and complementary hook hence together form locking means whereby the front side 112 and base 118 are releasably locked together.

A hole 112.3 is provided in the upper surface 122 of the horizontal top member 112.1 adjacent each end thereof. The holes 112.3 serve as locating holes for attachment to the ends 116. It will be appreciated that the holes 112.3 may be through-holes which extend through the top and bottom of horizontal top member 112.1.

For brevity, in the specification, channel-like members or members or elements of channel section (collectively referred to as channel-like members) will be understood to include an element or member with two elongate side elements or flanges of relatively small breadth extending roughly perpendicular from lateral edges of an elongate centre element or web also with relatively small breadth, thereby forming an elongate tray. In this regard, the depth of the channel-like member will be understood to indicate a depth X, as shown in FIG. 4*b*. Similarly, the width of the channel-like member will be understood to include the distance Y, also shown in FIG. 4*b*.

Figures 3A, 3B:
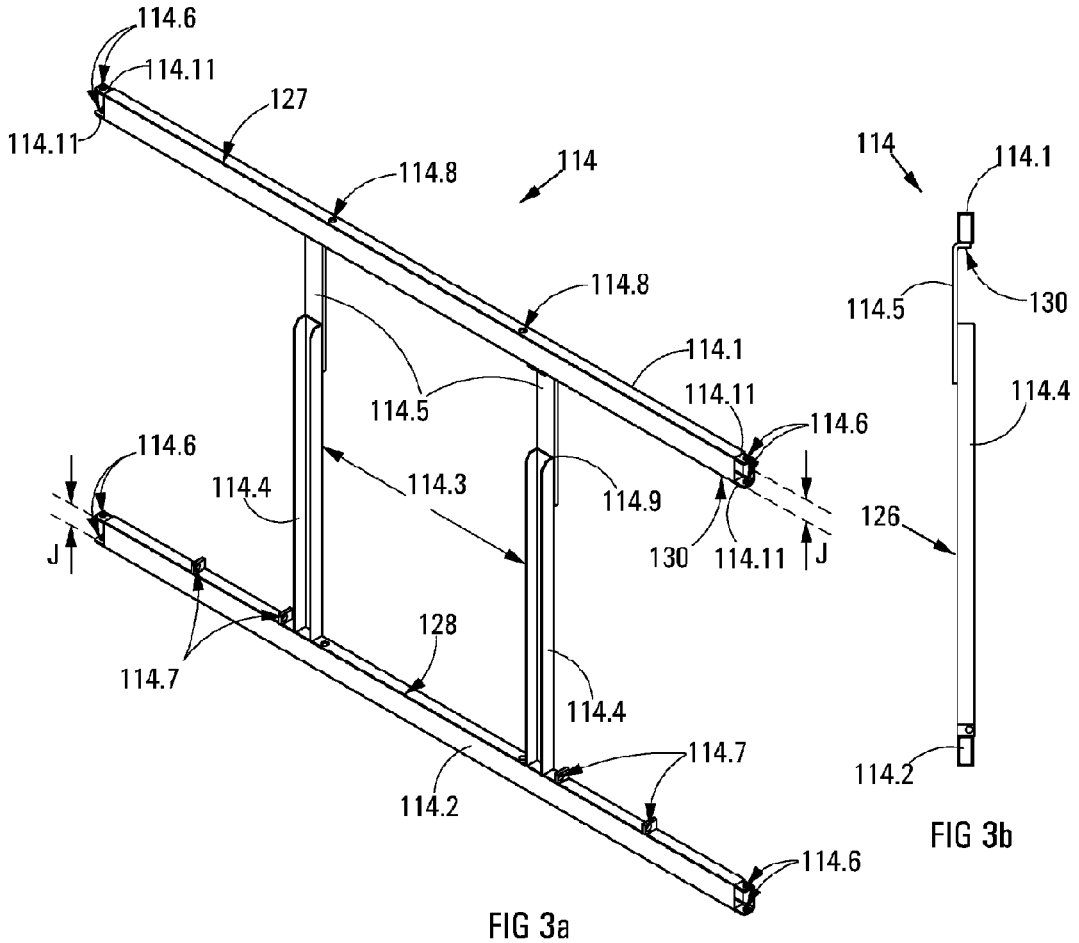
FIGS. 3*a* and 3*b* show a three-dimensional front view and a side view of a rear side of the container of FIG. 1 respectively.

Referring to FIGS. 3*a* and 3*b*, the rear side 114 of the container 100 includes elongate tubular parallel top and bottom members 114.1 and 114.2 of generally rectangular section. The rear side 114 also includes a pair of parallel connecting members 114.3, connected to the top member 114.1 and bottom member 114.2. Each connecting member 114.3 includes a bottom element 114.4 of channel section and a top element 114.5 formed of flat bar attached to a rear surface 126 of the bottom element 114.4. The bottom element 114.4 extends upwardly from an upper surface 128 of the bottom member 114.2. An end portion of top element 114.5 is bent to provide the element 114.5 with an inverted L-shape. The end portion of the top element 114.5 is attached to a bottom surface 130 of the top member 114.1 such that the bottom element 114.4 is in the same vertical plane as the top member 114.1 and the bottom member 114.2, as can be seen in FIG. 3*b*.

The top and bottom members 114.1, 114.2 include aligned vertical through-holes 114.6 provided in flanges 114.11 at respective ends thereof for hinged connection to the ends 116. The bottom member 114.2 also includes, on the top surface 128, a pair of spaced apart transversely extending hinge brackets 114.7 on either side of the connecting members 114.3. The hinge brackets 114.7 define horizontally aligned holes for hinged connection of the base 118 of the container 100.

Figure 4A:
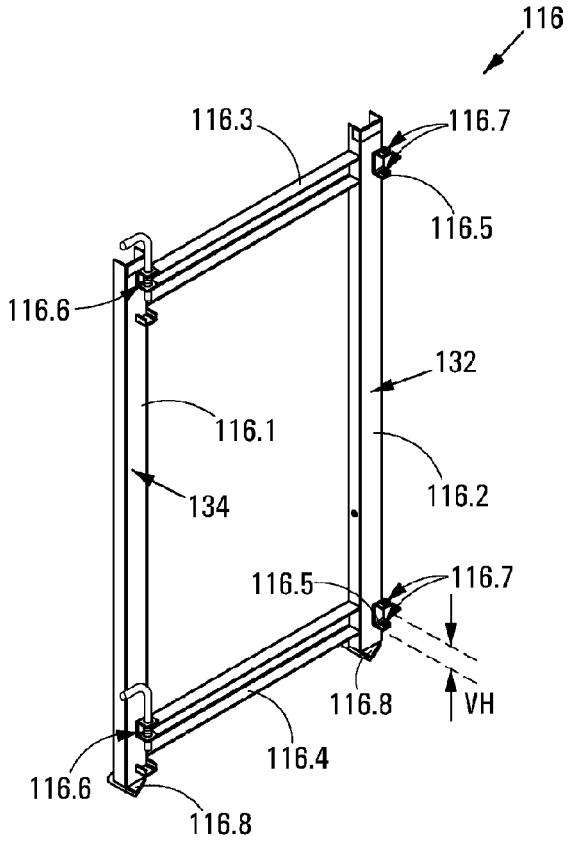
FIGS. 4*a* and 4*b* show three-dimensional rear view and front views of an end of the container of FIG. 1 respectively.
Figure 4B:
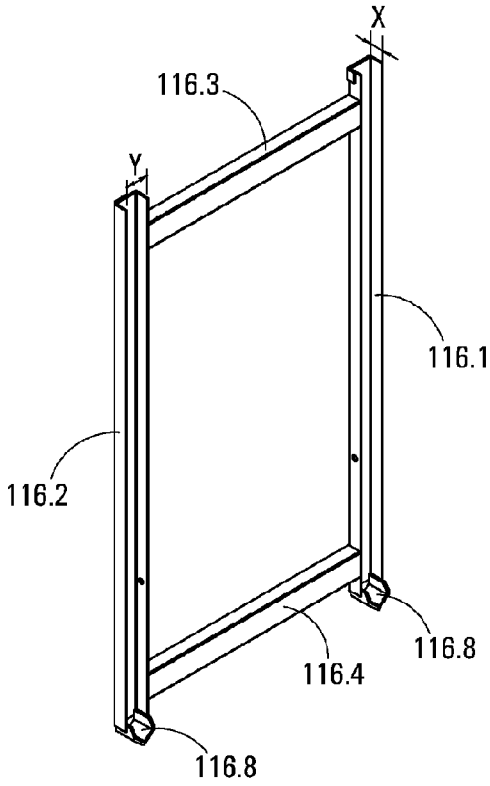

Referring to FIGS. 4*a* and 4*b*, each end 116 includes elongate parallel channel-like side members 116.1 and 116.2, connected to and extending between parallel channel-like top and bottom members 116.3, 116.4. The channels of the side members 116.1, 116.2, and the top and bottom members 116.3, 116.4 are disposed in opposite directions to each other. It will be appreciated that the two ends 116*a* and 116*b* are similar and are provided at each end of the container 100 but for ease of explanation reference is made to one end 116*a*.

The side member 116.2 includes two U-shaped mounting brackets 116.5 disposed cantilever fashion on a rear surface 132, on a top and bottom thereof. The mounting brackets 116.5 include vertically aligned through-holes 116.7 provided in respective flanges thereof in which securing elements are receivable for hinged attachment to the end of the rear side 114 (explained in greater detail below).

The side member 116.1 includes a sprung clip arrangement 116.6 on a rear surface 134 and at a top and bottom thereof for disconnectable connection with the end of the front side 112 and for disconnectable connection with an end of the base 118 respectively. The side members 116.1, 116.2 include roughly triangular locating feet 116.8 provided at respective bottom ends for location of one container or pallet 100 on top of another container 100 when the containers are in their erect conditions.

Figure 5:
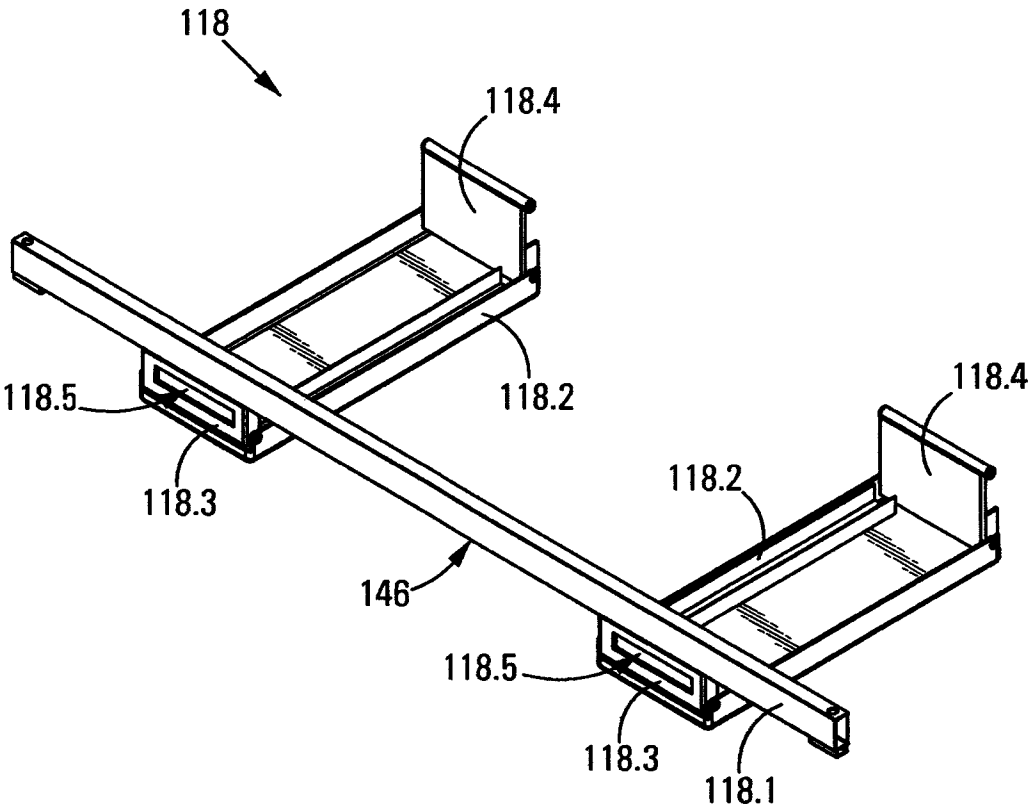
FIG. 5 shows a schematic drawing of a three-dimensional view of a base of the container of FIG. 1.

Referring to FIG. 5, the base 118 includes an elongate tubular horizontal cross member 118.1 of general rectangular section and two parallel roughly rectangular tray-like bracing members 118.2. Each bracing member 118.2 is hingedly connected to the cross member 118.1 by way of a rigid rectangular plate 118.3, and is hingedly connected to a back plate 118.4. Each rigid rectangular plate 118.3 is attached to and extends downwardly from a bottom surface 146 of the cross member 118.1. The back plate 118.4 is hingedly connectable to the bottom member 114.2 via the hinge brackets 114.7. Ends of the cross member 118.1 define vertical, aligned through-holes for connection to the side members 116.1 of the ends 116.

The bracing members 118.2 rest on the ground, when the container is in the erect condition, thereby effectively increasing the height of the erect container by a factor determined by the height of the back plate 118.4 and the rectangular plate 118.3. It will be appreciated that the erect container 100 abuts the ground solely by way of the bracing members 118.2. Further, the rectangular plates 118.3 define locating arrangements in the form of locating apertures 118.5, to receive tines or prongs of a fork-lift, or the like, thereby facilitating handling of the container 100 by way of a fork-lift.

The bracing members 118.2 serve to increase the structural rigidity of the erect container 100 when in use.

In construction and assembly to an erect condition, the back plate 118.4 is hingedly secured to the hinge brackets 114.7 on the bottom member 114.2 of the rear side 114 by way of bolts, pins, screws, or the like thereby hingedly to secure the base 118 to the rear side 114.

The top and bottom members 114.1, 114.2 of the rear side 114 are positioned in the U-shaped mounting brackets 116.5 such that respective through-holes 114.6 of the top and bottom members 114.1, 114.2 are aligned with the through-holes 116.7 of the mounting brackets 116.5. Securing elements in the form of pins, bolts, or the like are then passed through the aligned through-holes to hingedly connect the ends 116 to the rear side 114. A space J (FIG. 3*a*) provided between the flanges 114.11 at the ends of the top and bottom members 114.1, 114.2 is bigger than the vertical height VH (shown in FIG. 4*a*) of the U-shaped mounting brackets 116.5. In this way, the flanges of the mounting bracket 116.5 are receivable within the spaces J respectively.

It will be understood that in an erect condition, the horizontal length L (FIG. 9) of the container 100 is calculated as the length of the rear side 114 together with at least the depth X of the side members 116.2 of the ends 116. In addition, the horizontal length L of the container 100 also includes part of the length of the mounting brackets 116.5.

The container 100, at this stage, is in a constructed condition and further explanation pertains to assembling the container 100 to an erect condition.

Ends of the cross member 118.1 of the base 118 are then respectively positioned in the sprung clip arrangements 116.6 at the bottom of the side members 116.1 of the ends 116. The sprung clip arrangements 116.6 are operated thereby to allow clips thereof to pass through the through-holes at the ends of the cross member 118.1 thereby securing/locking the base 118 to the ends 116.

The hooks (not shown) of the base 118 are passed through the apertures 112.4 to lock/secure the lower ends of the vertical members 112.2 of the front side 112 to the base 118. Respective ends, particularly the through-hole 112.3 at the ends, of the horizontal top member 112.1 of the front side 112 are then aligned with the sprung clip arrangements 116.6 provided on the top of side members 116.1. The sprung clip arrangements 116.6 are then operated to secure/lock the front side 112 to the ends 116. The container 100 is now in an erect condition as shown in FIG. 1, and goods, e.g. windscreens, may be loaded into the load space 102 for transport thereof.

In use referring now also to FIGS. 6 to 9, when a container 100 in an erect condition is to be reduced to a collapsed condition, e.g. after the goods contained therein have been delivered to a desired destination, the sprung clip arrangements 116.6 at the top of the side members 116.1 and the hooks of the base 118 are operated thereby to permit the front side 112 to be removed from the ends 116 and base 118 of the container 100.

The sprung clip arrangements 116.6 at the bottom of the side members 116.1 are then operated to release the cross member 118.1 of the base 118 from the ends 116. The base 118 is pivoted about axes 140, 142, and 144 (shown in FIGS. 1 and 7) such that the base 118 is parallel to the rear side 114. The bottom surface 146 of the cross member 118.1 abuts shoulders 114.9 of the bottom members 114.3 formed by the ends of the channels such that the cross member 118.1 is in register with the top member 114.1. By abutting the shoulders 114.9, the base 118 is thereby restrained from downward movement. In this regard the base 118, or the rear side 114, may include securing means in the form of clips, or the like to secure the base 118 to the rear side 114.

Figure 6:
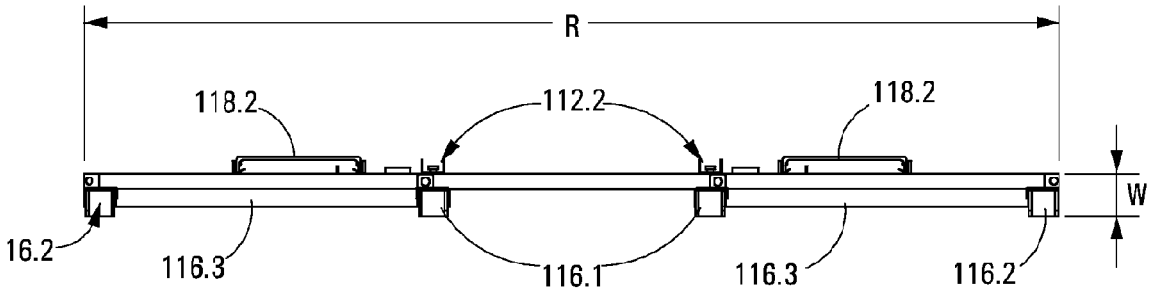
FIG. 6 shows a schematic drawing of a top view of the container of FIG. 1 in a collapsed condition.
Figure 7:
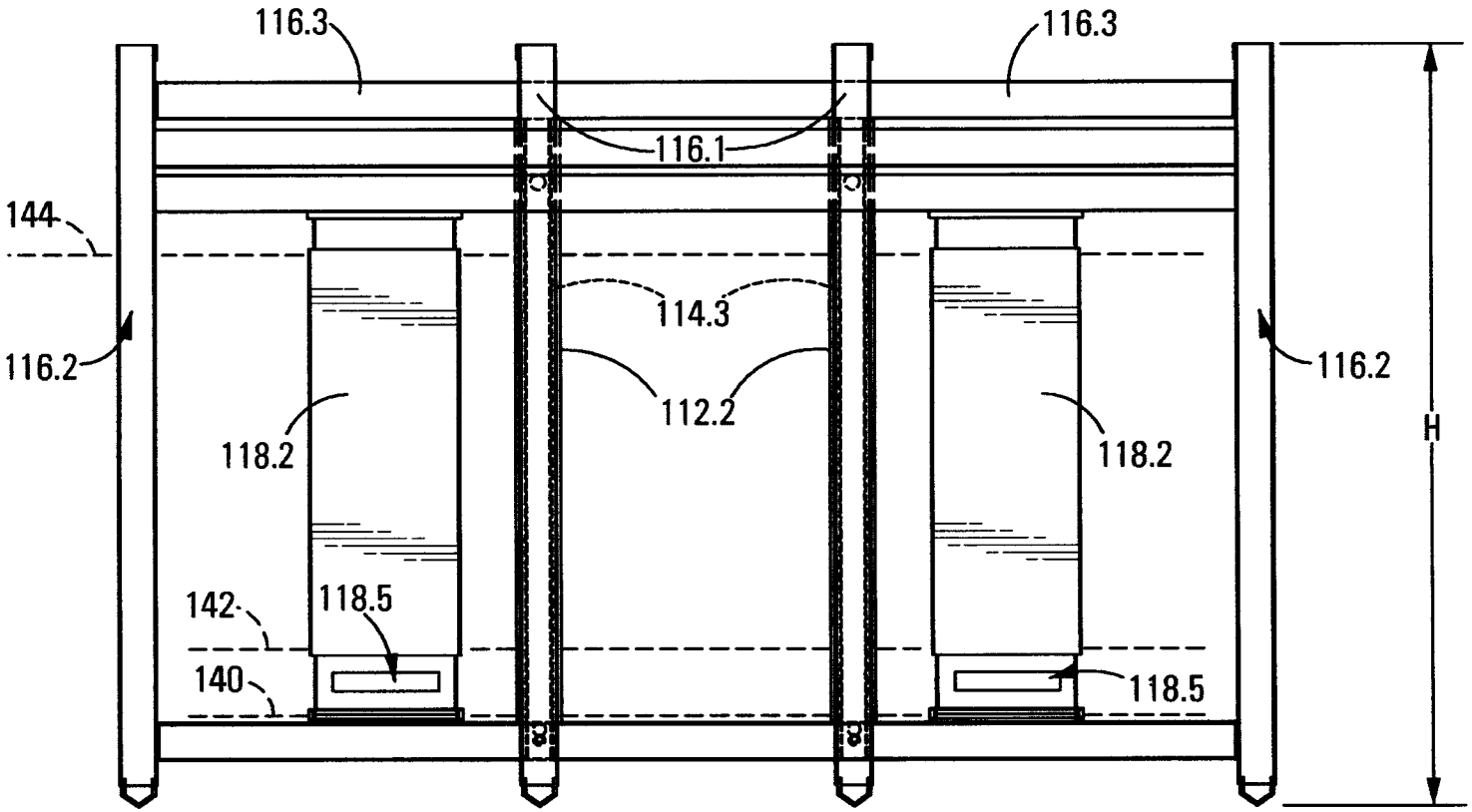
FIG. 7 shows a schematic drawing of a front view of the container of FIG. 1 in the collapsed condition.

The front side 112 is then disconnected from the ends 116 and positioned nested-fashion into the rear side 114 such that the top member 112.1 of the front side 112 lies between and is in register with the top member 114.1 and the cross member 118.1 of the base, as shown in FIG. 7. The vertical members 112.2 lie behind the rear side (as can be seen in FIG. 6) such that the channels of the vertical members 112.2 are rearwardly open (away from the rear side 114).

Figure 8:
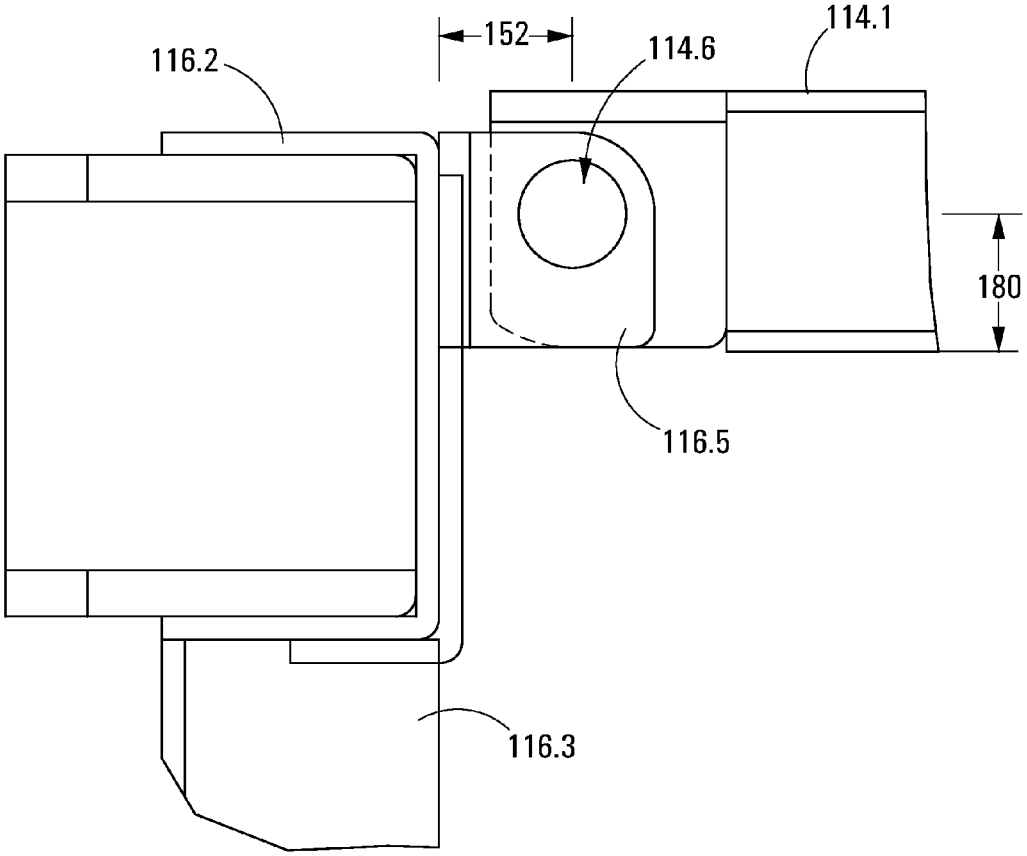
FIG. 8 shows a part-sectional schematic view of a portion of the container of FIG. 1.

The ends 116 are swung about axes 150 in the directions of arrows 160 and 162 (as shown in FIG. 1) such that rear surfaces of the ends 116 abut the rear side 114 (shown more clearly in FIG. 6). It will be understood that the mounting brackets 116.5 are arranged such that when the ends 116 are swung to the rear side 114 (in the direction of arrows 160 and 162), the overall horizontal length L of the container 100 is reduced by the depth X of the channel of each of the side members 116.2, and at least part of the lengths of the mounting brackets 116.5, as hereinbefore described. In this regard, referring particularly to FIG. 8, it will be appreciated that to ensure that the ends 116 abut the rear side 114 in the closed position, the centre distance 180 of the ends of the top and bottom members 114.1, 114.2 must be roughly equal to the centre distance of the mounting bracket 116.5, as shown in FIG. 8.

It will be understood that with the ends 116 abutting the rear side 114, the width W (FIG. 6) of the container 100 is thereby reduced in the collapsed condition to the width of the rear side 114 i.e. the width of the top member 114.1 or bottom member 114.2, together with the depth X of one the side members 116.1 or 116.2 and roughly part of the depth of the vertical members 112.2 of the front side 112.

As shown in FIG. 6, the vertical members 112.2 of the front side 112 are spaced apart such that when in the collapsed condition, the vertical members 112.2 are aligned with the side members 116.1. In other words, the horizontal length from the respective ends of the top member 112.1 to the respective vertical members 112.2 equals the total horizontal length of the end 116, as shown in FIG. 6.

The sprung clip arrangements 116.6 at the top of the side members 116.1 are operable to receive the top member 114.1 and also operable to secure/lock the top member 114.1 thereto by way of the sprung clip arrangements 116.6. In this regard, it will be noted that the rear side 114 includes two spaced apart holes 114.8 on a top surface 127 of the top member 114.1 to receive clips of the sprung clip arrangements 116.6. By securing the ends 116 to the rear side 114, the container 100 is thereby reduced to an easily transportable collapsed condition.

To render the collapsed container 100 to a constructed condition, as described above, for assembly to an erect condition, the sprung clip arrangements 116.5 are operated to free the ends 116 from the rear side 114. The ends 116 are then swung away from the rear side 114 about axes 150. The front side 112 is then removed from the rear side 114. The base 118 is removed from abutment with the shoulders 114.9 of the bottom member 114.4 and is pivoted about axes 140, 142, 144 (shown in FIGS. 1 and 7) to allow the bracing members 118.2 to abut the ground. The container 100 is thereafter assembled to the erect condition as hereinbefore described.

Figure 9:
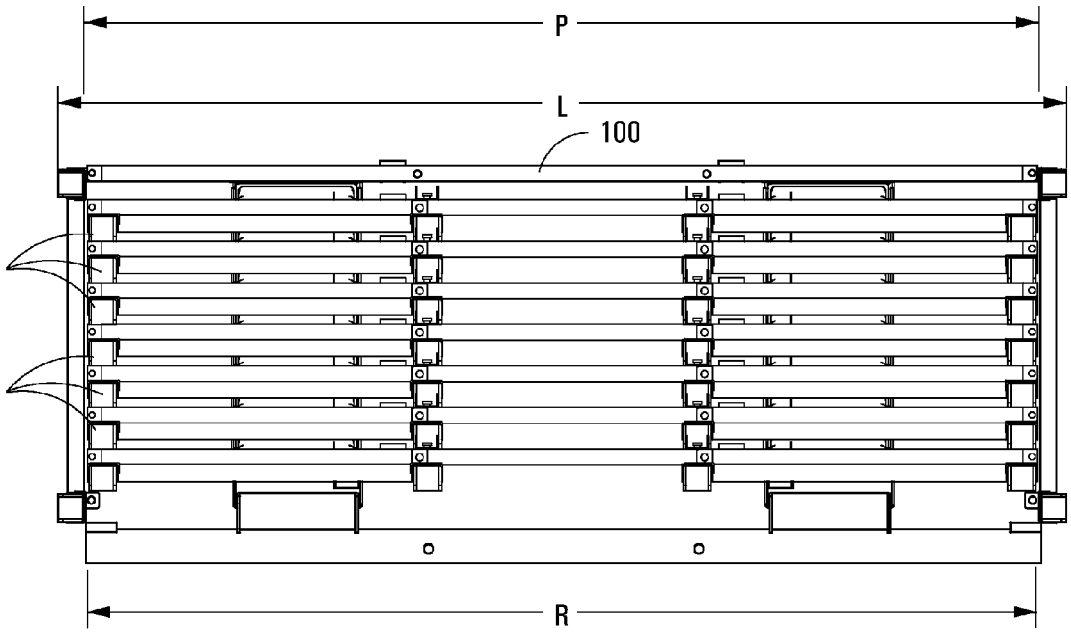
FIG. 9 shows a schematic drawing of a top view of plurality of packed containers in the collapsed condition of FIG. 6 within an erect container.

In use, referring to FIG. 9 of the drawings, a plurality of containers 100 in the collapsed condition are aligned and packed adjacent one another. It will be appreciated that U-shaped channel of the side members 116.1 typically has a channel width Y greater than the width of the vertical members 112.2 such that the vertical members 112.2 are receivable therein during packing. It will be further appreciated that once packed, the U-shaped channels of the vertical members 112.2 of a packed container 100 are exposed for another collapsed container to be received, a plurality of collapsed containers 100 may be packed in this fashion, i.e. with the members 112.2 of one container nesting in the side members 116.1 of an adjacent container.

The packed collapsed containers 100 are receivable within the load space 102 of an erect container 100. This is possible because the overall horizontal length L of an erect container 100 is greater than the horizontal length R of a collapsed container 100 (FIG. 9 and FIG. 6). In particular, it will be appreciated that a load space 102 of an erect container 100 has a greater horizontal length P than the horizontal length R of a collapsed container 100.

Further, in this particular embodiment of the invention, the overall depth D (shown in FIG. 1) of the load space 102 of an erect container 100 is greater than the height H (shown in FIG. 7) of the collapsed container 100. This is due to the fact that the erect container 100 rests on the bracing members 118.2, thereby increasing the depth D of the load space 102 by a factor determined by the height of the back plate 118.4 and the rectangular plate 118.2 whereas the height H of the collapsed container 100 is determined by the height of the rear side 114 and/or the ends 116. This difference in the depth D of the container 100 as compared to the height H of the collapsed container 100, as well as the horizontal alignment of the protruding vertical frame members, permits a plurality of packed collapsed containers 100 to be receivable within the load space 102 of an erect container 100. The erect container 100, with packed containers 100 therein, may be stackable on top of each other to permit easy transport and return thereof from the destination. It will be appreciated that the locating feet 116.8 of the side members 116.1 are used to locate an erect container 100, with the packed containers 100 therein, on top of another erect container 100 during stacking thereof. In other words, the locating feet 116.8 are receivable within tops of side members 116.1, 116.2 of other erect containers 100 during stacking of erect containers 100.

Figure 10:
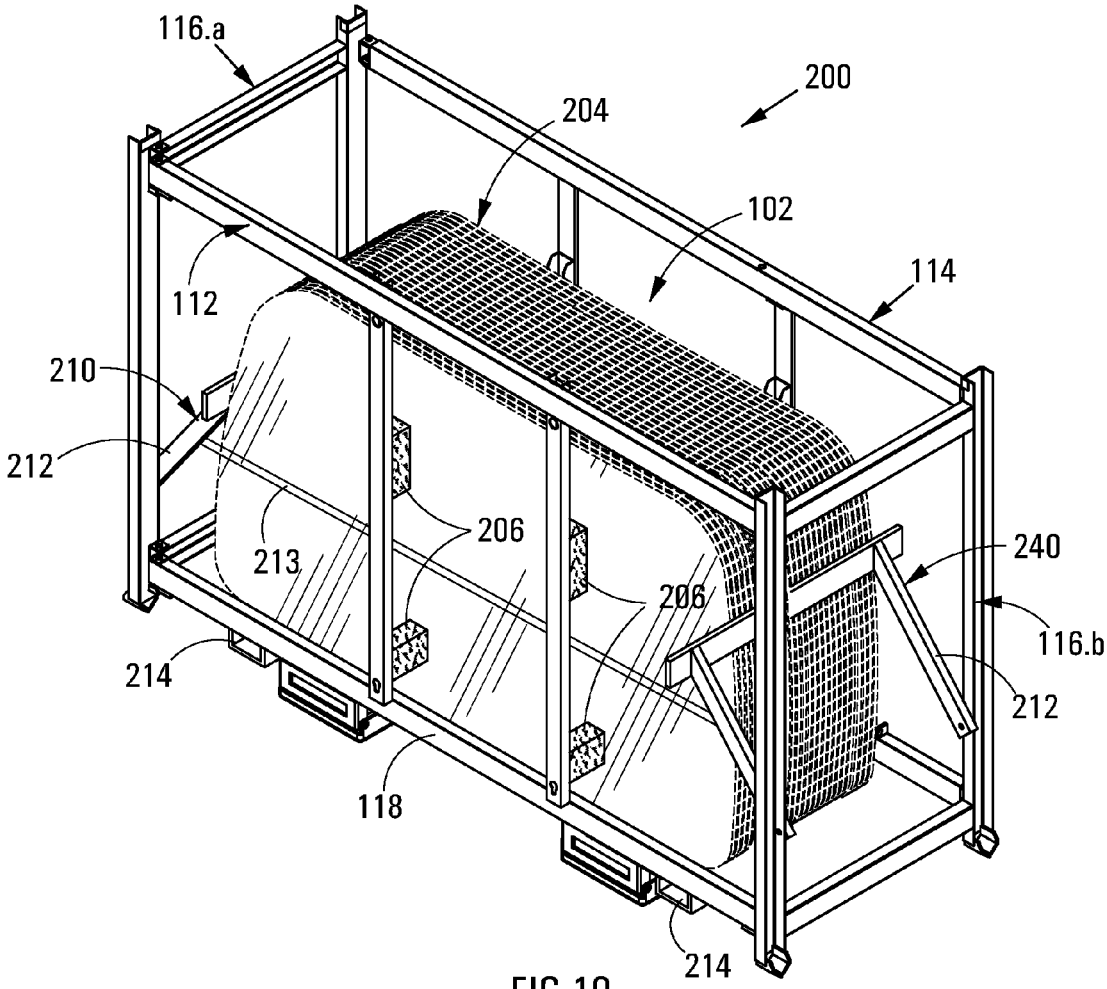
FIG. 10 shows a three-dimensional schematic drawing of another example embodiment of a container in accordance with the invention.

Referring to FIG. 10 of the drawings, another embodiment of a container in accordance with the invention is generally referred to by reference numeral 200.

The container 200 is similar to container 100 and unless otherwise indicated, similar parts will be referred to by the same reference numerals. The container 200 further includes a mounting or bracing arrangement 210 to secure goods, typically fragile goods, to be transported within the container 200. In this particular embodiment of the invention glass sheets, particularly windscreens 204 are shown.

The arrangement 210 includes bracing formations 212 each secured to opposite ends **116*a* and 116*b* of the container 200. The bracing formations 212 are connected by way of two parallel spaced apart struts or ties 213 extending horizontally within the load space 102. The spaced apart struts or ties 213, and the bracing formations 212 define between them, a secure load space 102, within which fragile goods, such as the windscreens 204 are receivable. It will be appreciated that when transporting fragile goods, cushioning elements 206 such as foam, etc may be provided within the load space 102** thereby to surround the goods to prevent damage thereof.

The container 200 also includes locating formations 214 on a bottom surface 146 of the cross member 118.1. The locating formations 214 being shaped and/or dimensioned to receive tines or prongs of a fork-lift, or the like thereby facilitating handling of the container 200 by way of a fork-lift.

In one embodiment of the invention (not shown) the container includes a cushioning support member integral with the container to thereby support fragile goods.

Figure 11:
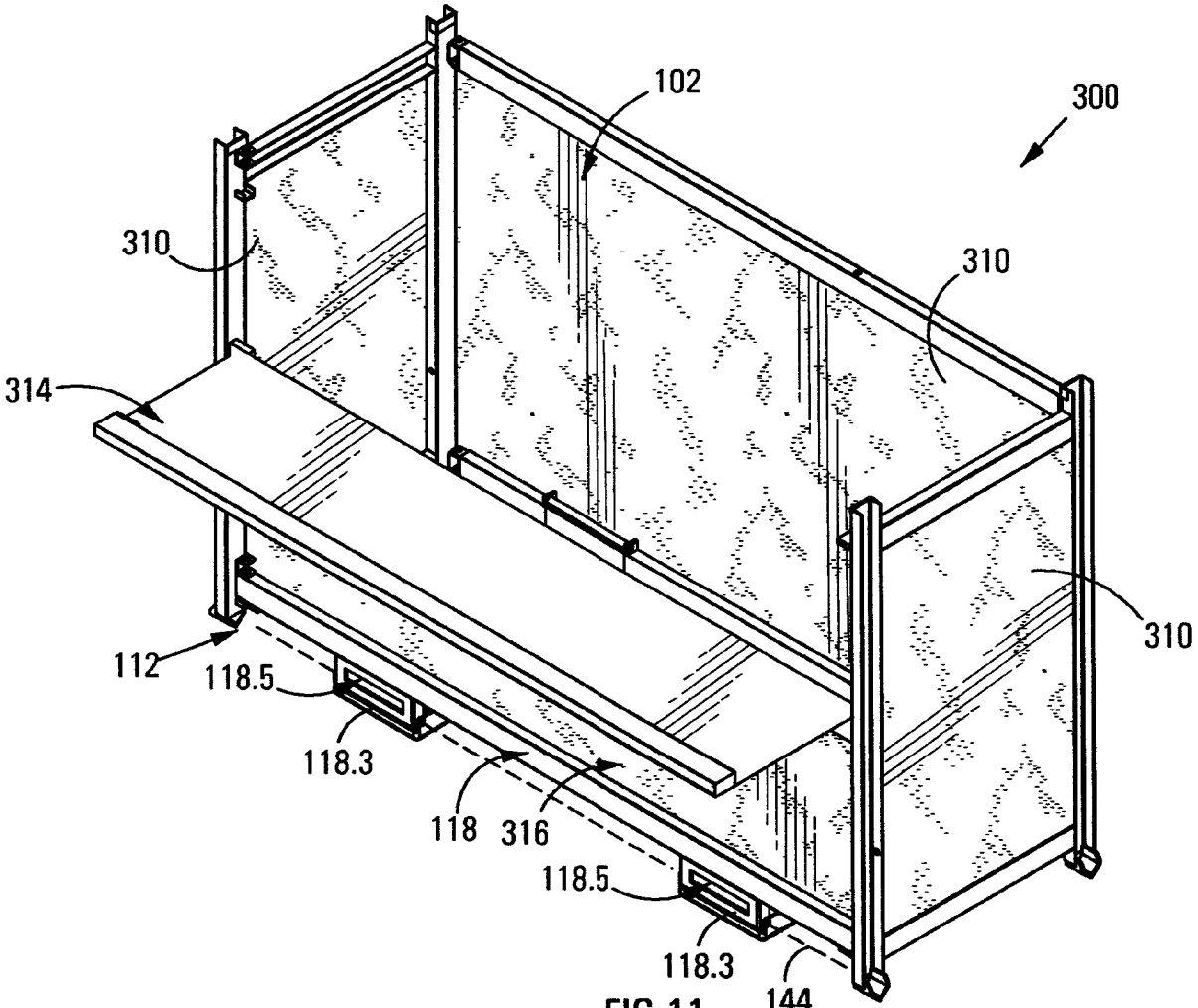
FIG. 11 shows a three-dimensional schematic drawing of further example embodiment of a container in accordance with the invention.

Referring now to FIG. 11 of the drawings, where another embodiment of the invention is generally indicated by reference numeral 300.

The container 300 is similar to the containers 100 and 200 and similar parts will therefore be referred to by the same reference numerals. The container 300 differs from the containers 100, 200 in that it includes cladding 310 between the frame members such that the container 300 is in the form of a bin when in the erect condition. The cladding may be in the form of aluminum sheets, synthetic plastics, or the like.

It will be noted that the front side 112 of the container 300 comprises two constituent parts namely an upper portion 314 hingedly connected to a lower portion 316.

This particular embodiment of the container 300 provides an enclosed load space 102 by virtue of the cladding. The enclosed load space advantageously aids in protecting goods placed therein. Also, the enclosed load space facilitates the transport of particulate material.

Referring now to FIGS. 12 to 19 of the drawings where another embodiment of the invention is generally indicated by reference numeral 400. The container 400 is similar to the containers 100, 200 and 300 and similar parts will therefore be referred to by the same reference numerals.

The front side 112, rear side 114, ends 116 and base 118 of the container 400 are constructed of sheet-like material such as sheet-metal, plastic, or the like such that they are generally planar. The container 400 includes a lid 410 hingedly connected to the top of the rear side 114 by way of a hinge 412 (shown in FIG. 14). The lid 410 is comprised of two panels 413,414 hingedly connected together. The panels 413, 414 are releaseably securable together such that the lid 410 may be pivotally displaceable as a single unit relative to the rear side 114 (as shown in FIG. 13) to permit access to the interior of the container 400 when the container is in its erect condition. The lid 410 is releasable securable to the top of the front side 112 such that the container 400 is in the form of a box when in the erect condition (FIG. 12).

Figure 15:
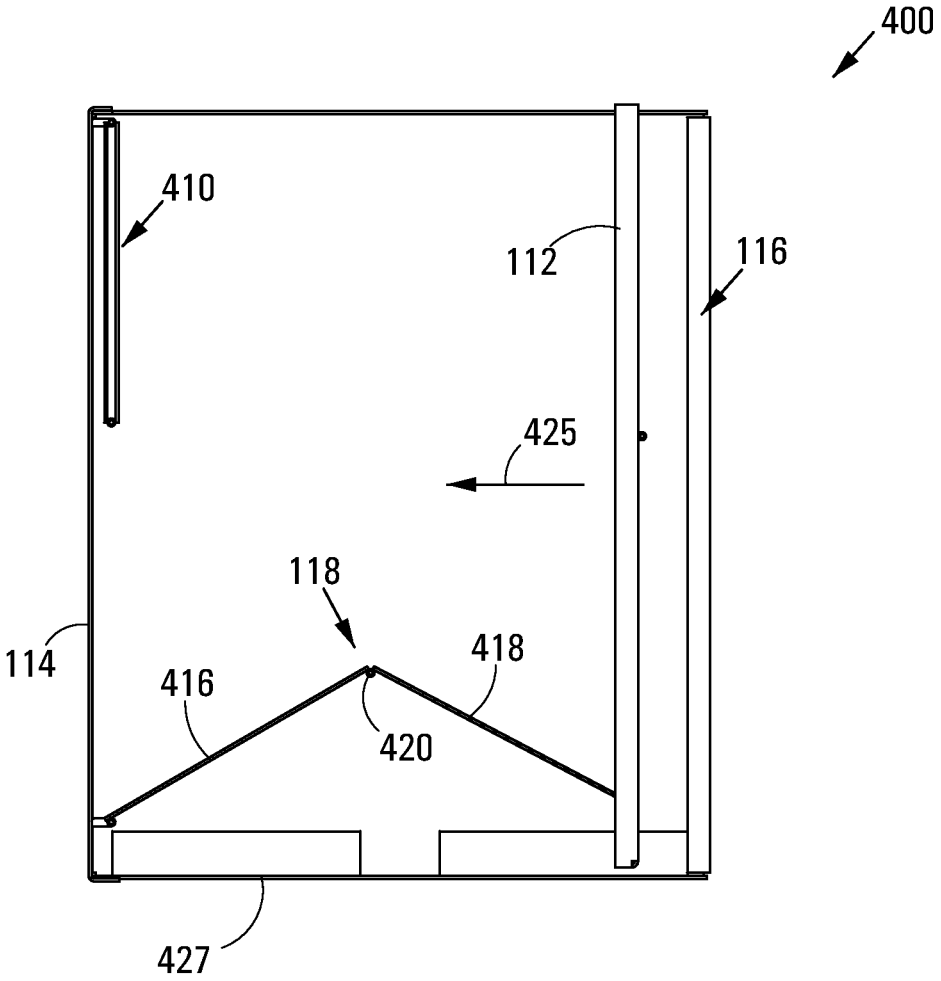

As can best be seen in FIG. 15, the base 118 of the container 400 includes two panels 416 and 418 (shown in FIGS. 14 and 15) hingedly connected together by way of a hinge 420.

Figure 12:
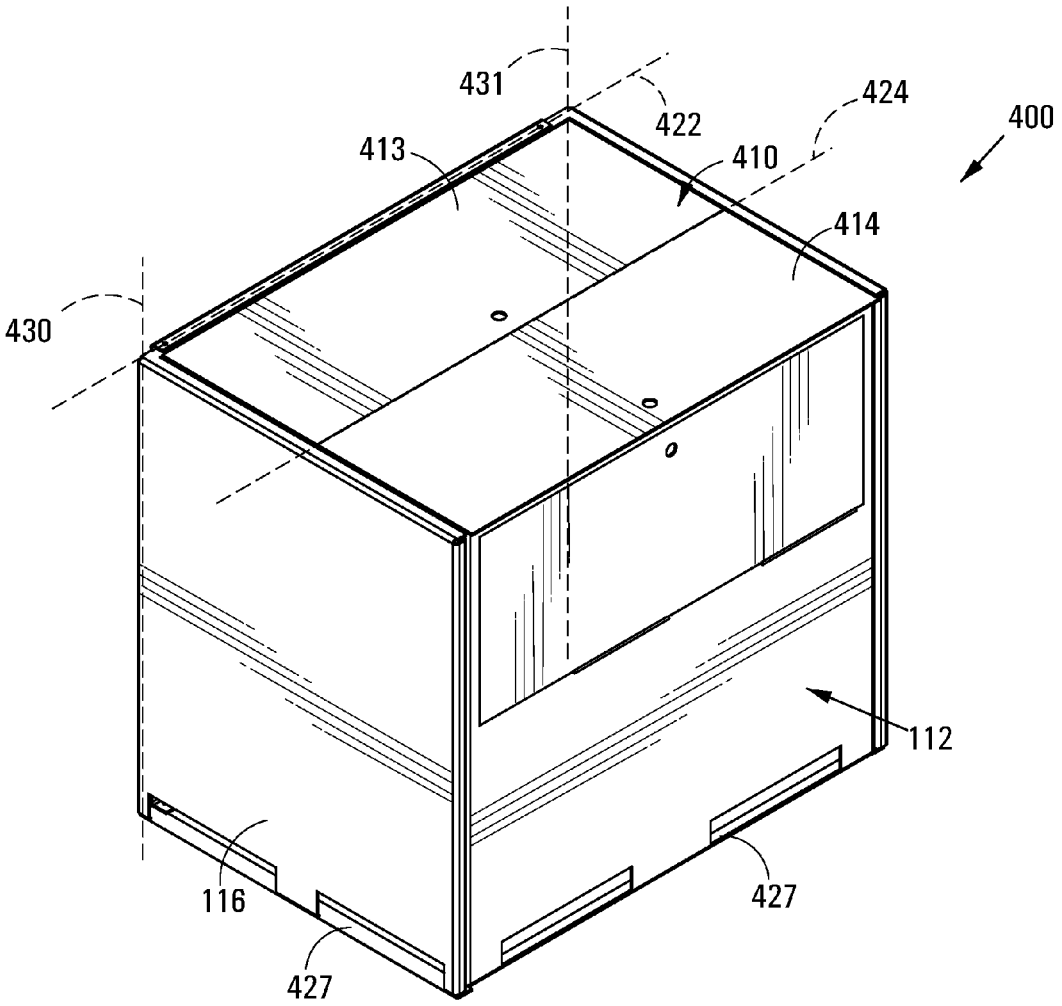
FIG. 12 shows a three-dimensional schematic drawing of another example embodiment of a container in accordance with the invention in an erect condition.
Figure 13:
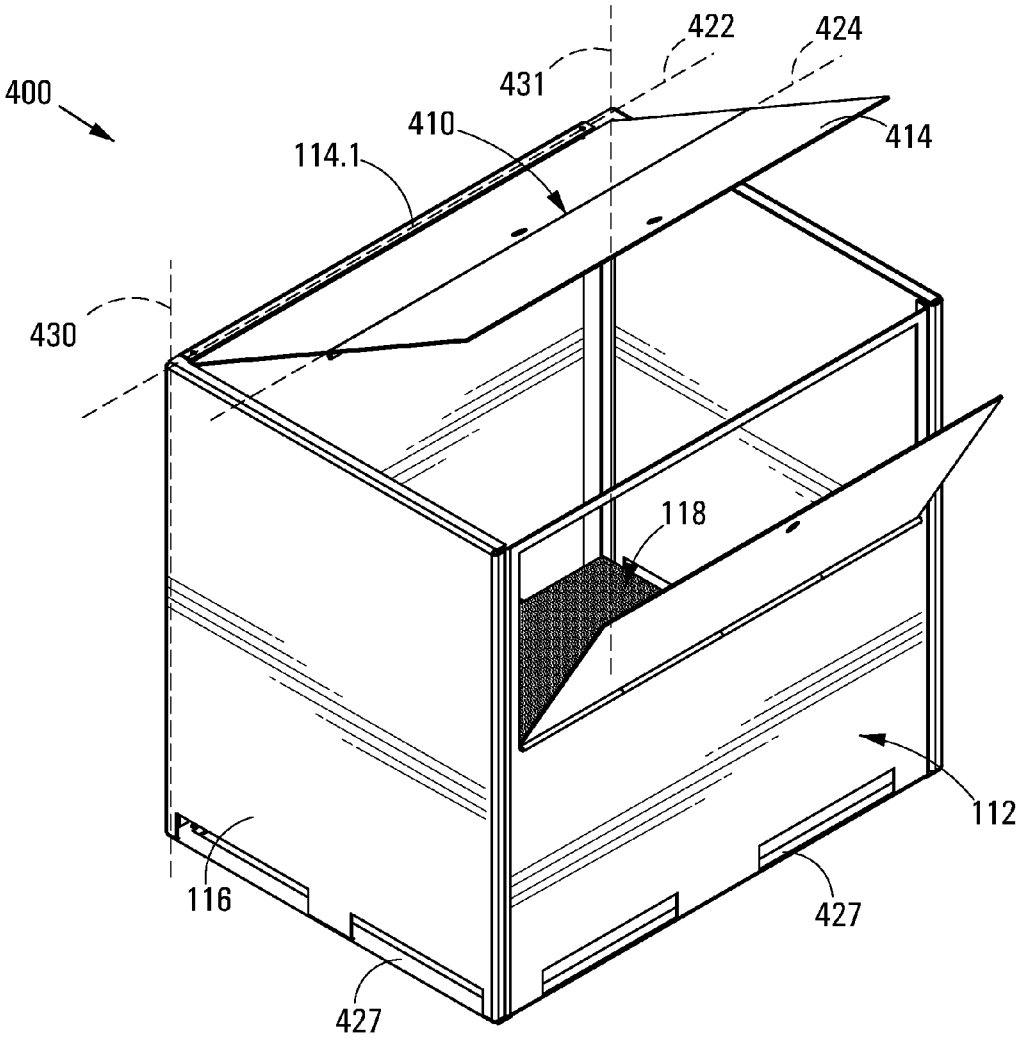
FIG. 13 shows another three-dimensional view schematic drawing of the container of FIG. 12.
Figure 14:
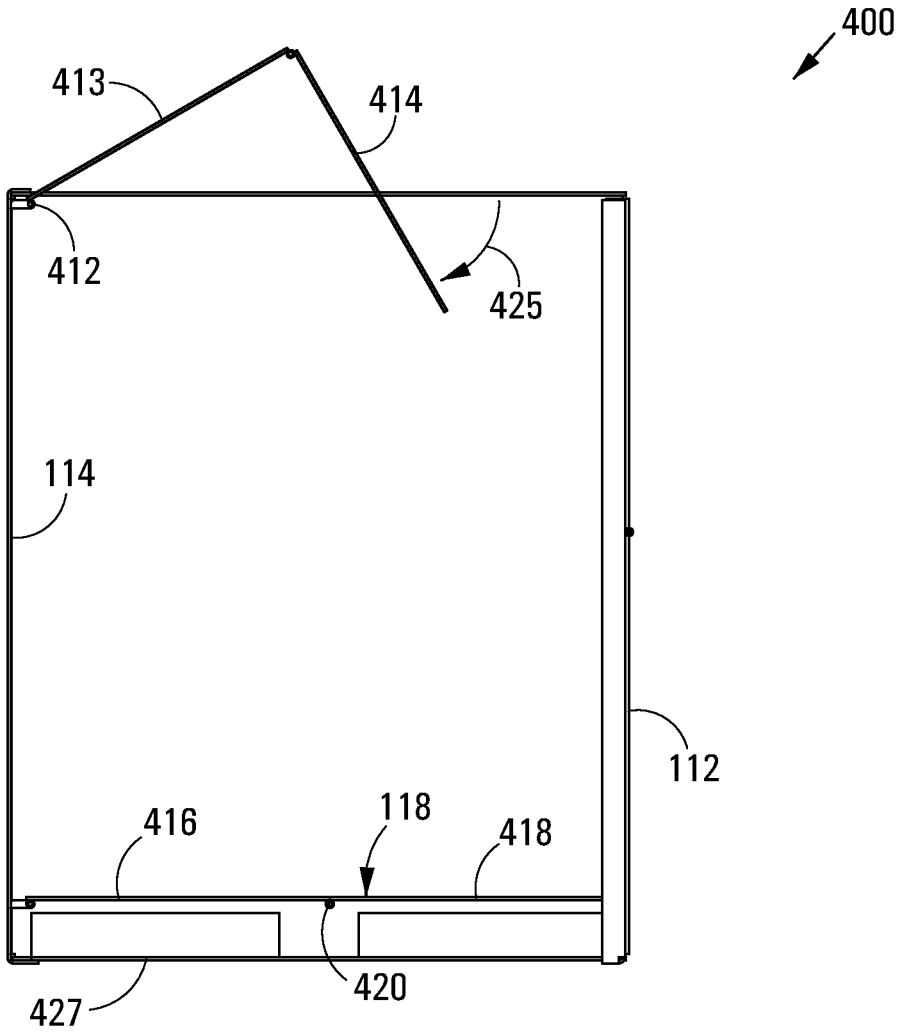
FIGS. 14 to 16 show sequentially schematic side views of the container of FIG. 12 being collapsed from its erect condition to its collapsed condition.

In use, referring to FIGS. 12 to 17 of the drawings, to render an erect container 400 (as shown in FIGS. 12 and 13) to a collapsed condition (as shown FIG. 17) the lid 410 of the container is released from attachment from the top of the front side 112 and is pivotally displaced away from the top member 112.1 about axis 422 (FIGS. 12 and 13). The panel 414 of the lid is then pivotally displaced about axis 424 (FIGS. 12 and 13) in the direction of arrow 425 (FIG. 14) relative to panel 413 such that it abuts the panel 413 or the rear side 114. It will be appreciated that the panel 413 is also pivotally displaced in the direction of the arrow 425 about axis 422 such that the lid 410 comes to rest with the panel 414 sandwiched between the rear side 114 and the panel 413.

Figure 16:
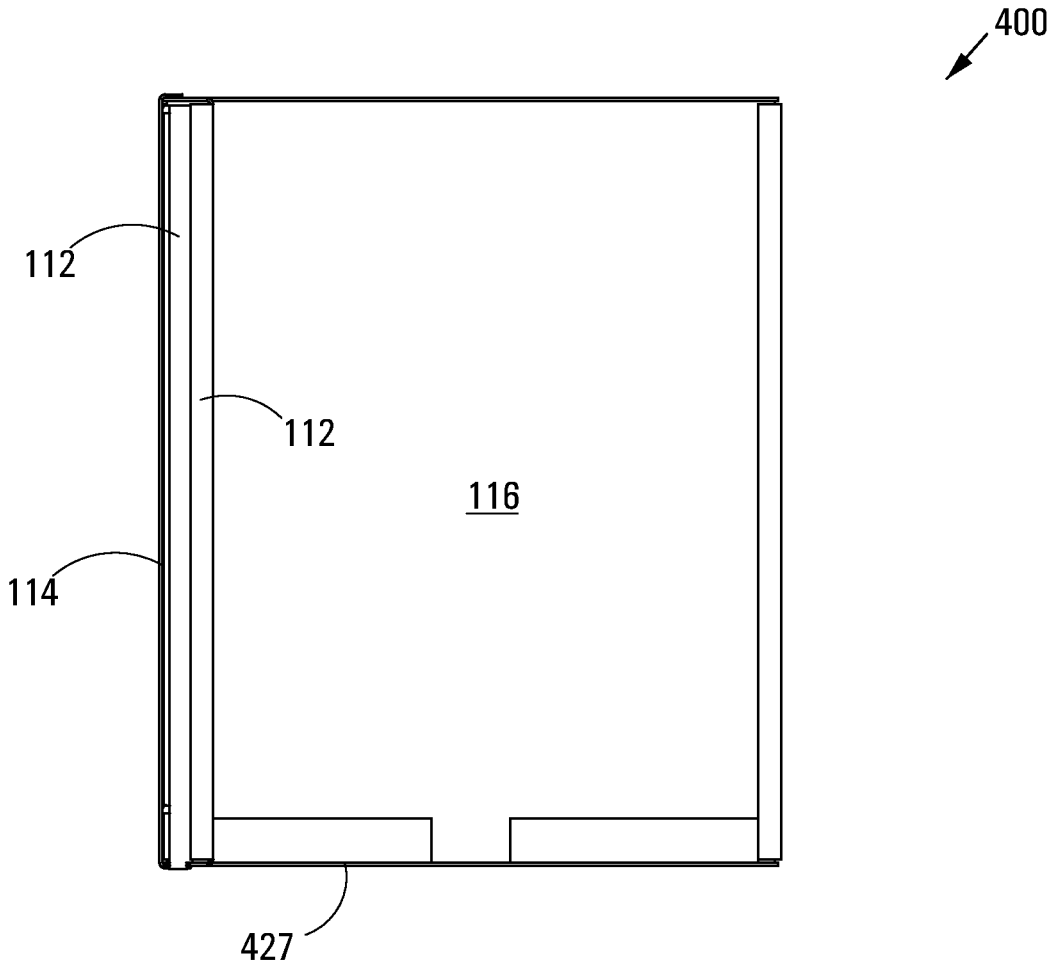

The front side 112 is then released from attachment with the ends 116 and is displaced in the direction of arrow 423 (FIG. 15) toward the rear side 114. It will be appreciated that because of the hinge 420 the parts of the base 416, 418 are pivotally displaced concertina-fashion as the front side moves in the direction of arrow 423. The front side 112 comes to rest adjacent the rear side 114 (FIG. 16).

It will be understood that at this intermediate stage, the container 400 is in a partly collapsed condition and has a U-shaped outline when viewed from below/above (FIG. 18) and defines a container receiving space 443.

Figure 17:
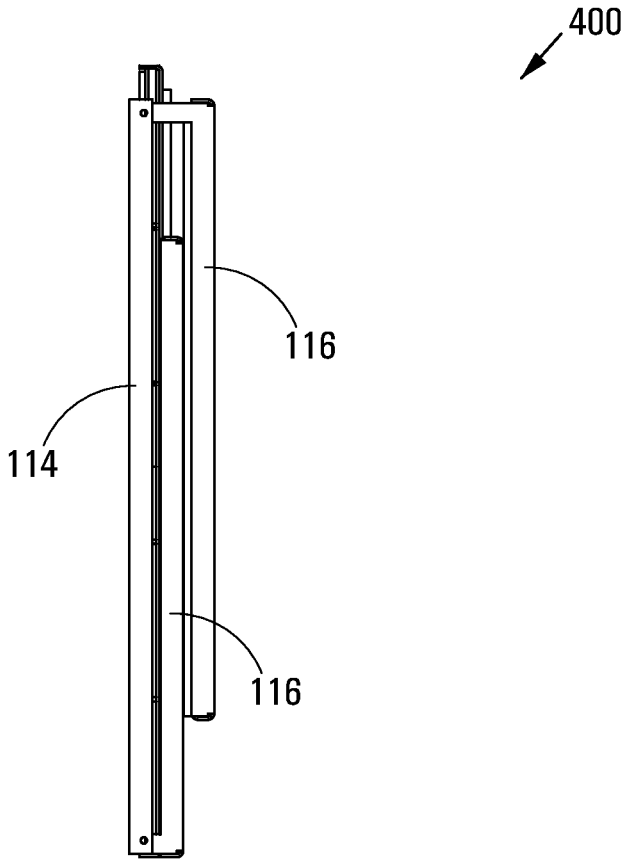
FIG. 17 shows a schematic top view of the container of FIG. 12 in a collapsed condition.

To render the container 400 to a completely collapsed condition, the ends 116 are pivoted about axes 430 and 431 (FIGS. 12 and 13) towards the rear side 114 such that they overlap as shown in FIG. 17.

Figure 18:
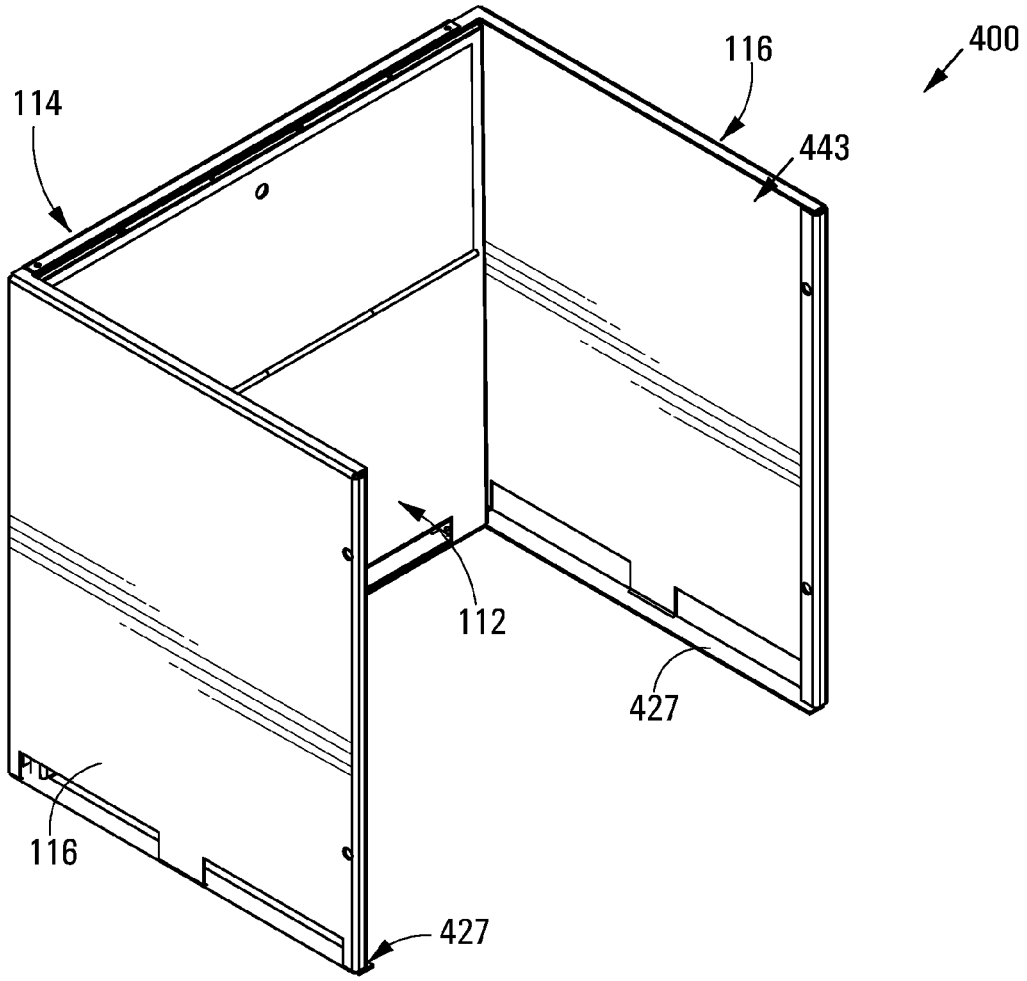
FIG. 18 shows a three-dimensional view of the container of FIGS. 13 to 17 in a partially collapsed condition.

It will be understood that to pack other like collapsed containers 400 for transport, the collapsed containers 400 are packed within a container 400 in its intermediate stage or partially collapsed condition referred to above and shown in FIG. 18. The collapsed containers 400 are packed into the container receiving space 443 between the ends 116 of the partially collapsed container 400 and are supported on support formations in the form of inwardly directed lips 427 provided at the lower edges of the ends 116. It will be appreciated that the support formations 427 provide a support surface on which the packed collapsed containers 400 rest during transport or handling of the packed container 400.

Figure 19:
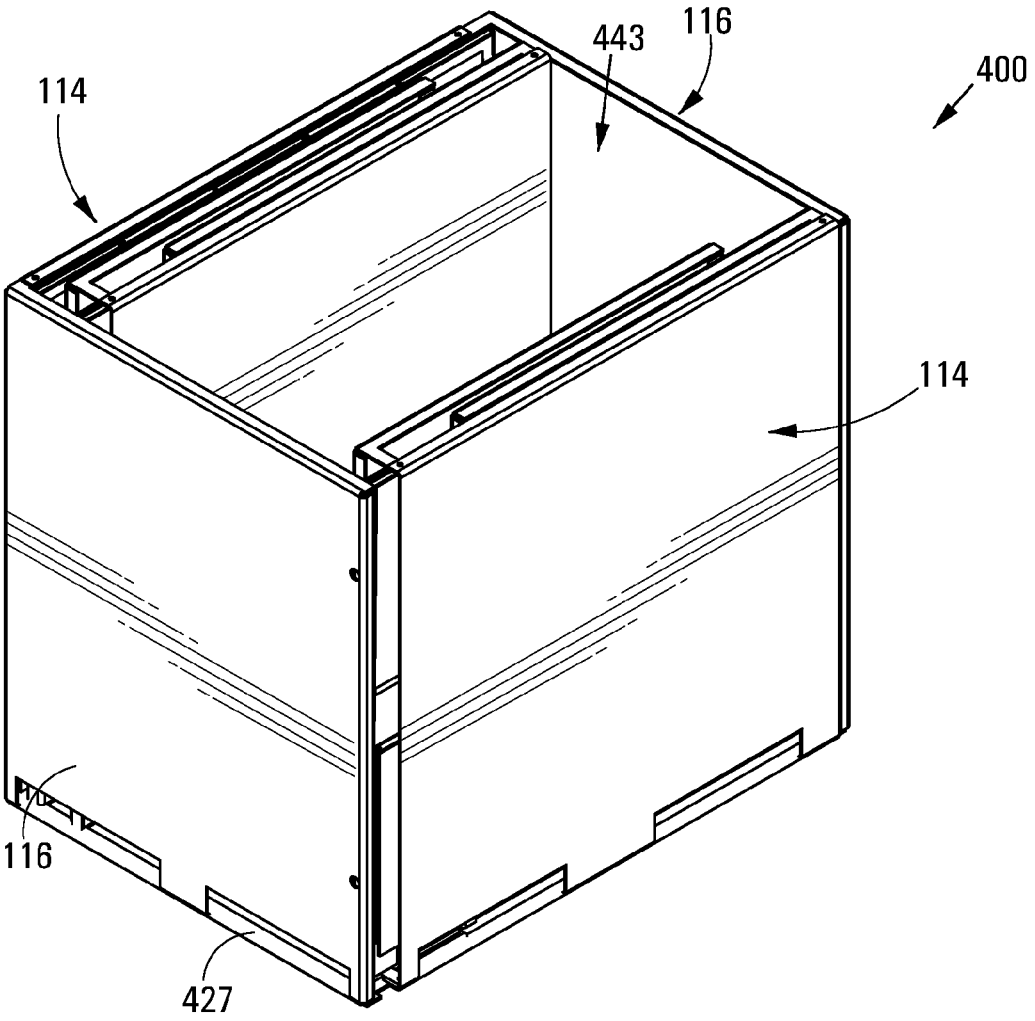
FIG. 19 shows in three-dimensional view, similar to FIG. 18 with collapsed containers being packed within the partially collapsed container of FIG. 18.
Figure 20:
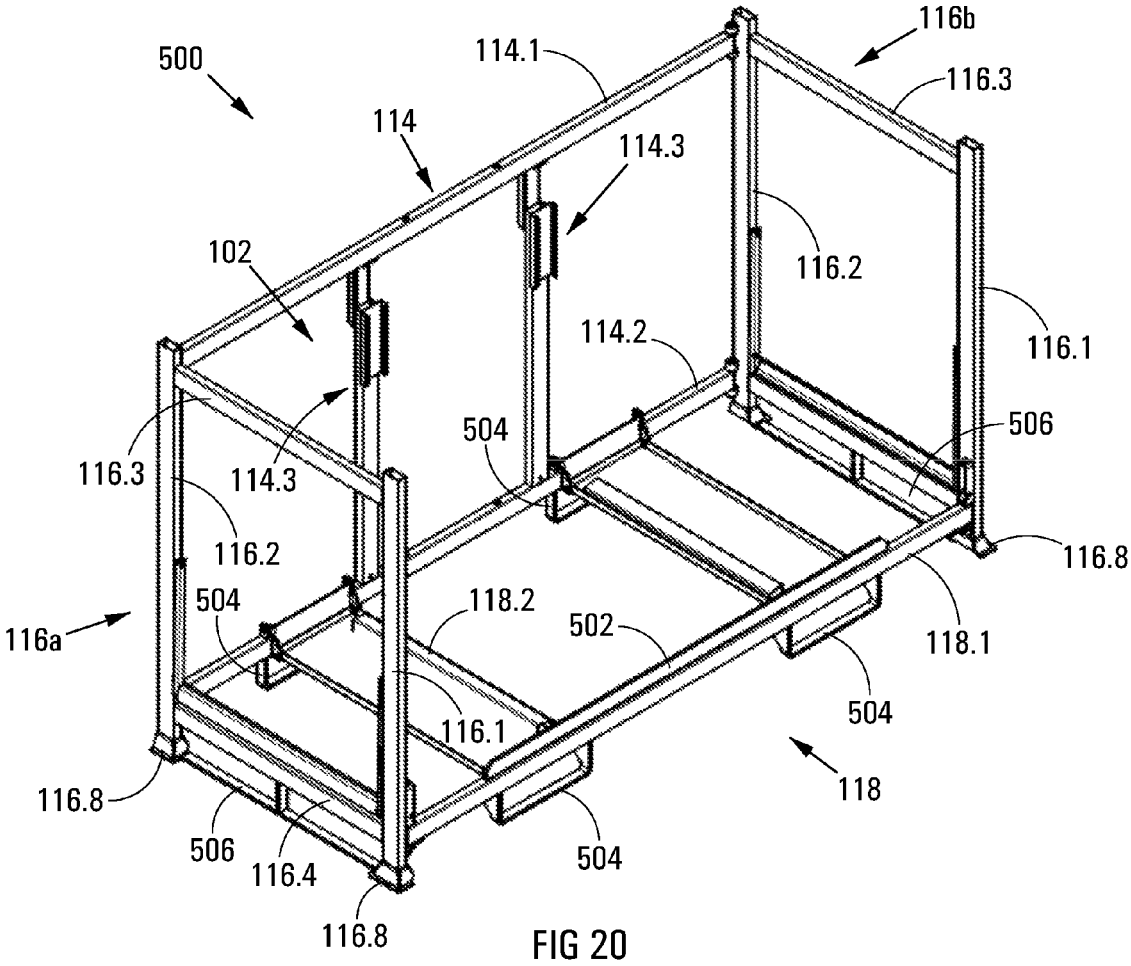
FIG. 20 shows a three-dimensional view, similar to FIG. 1, of yet another container in accordance with the invention in its erect condition.
Figure 21:
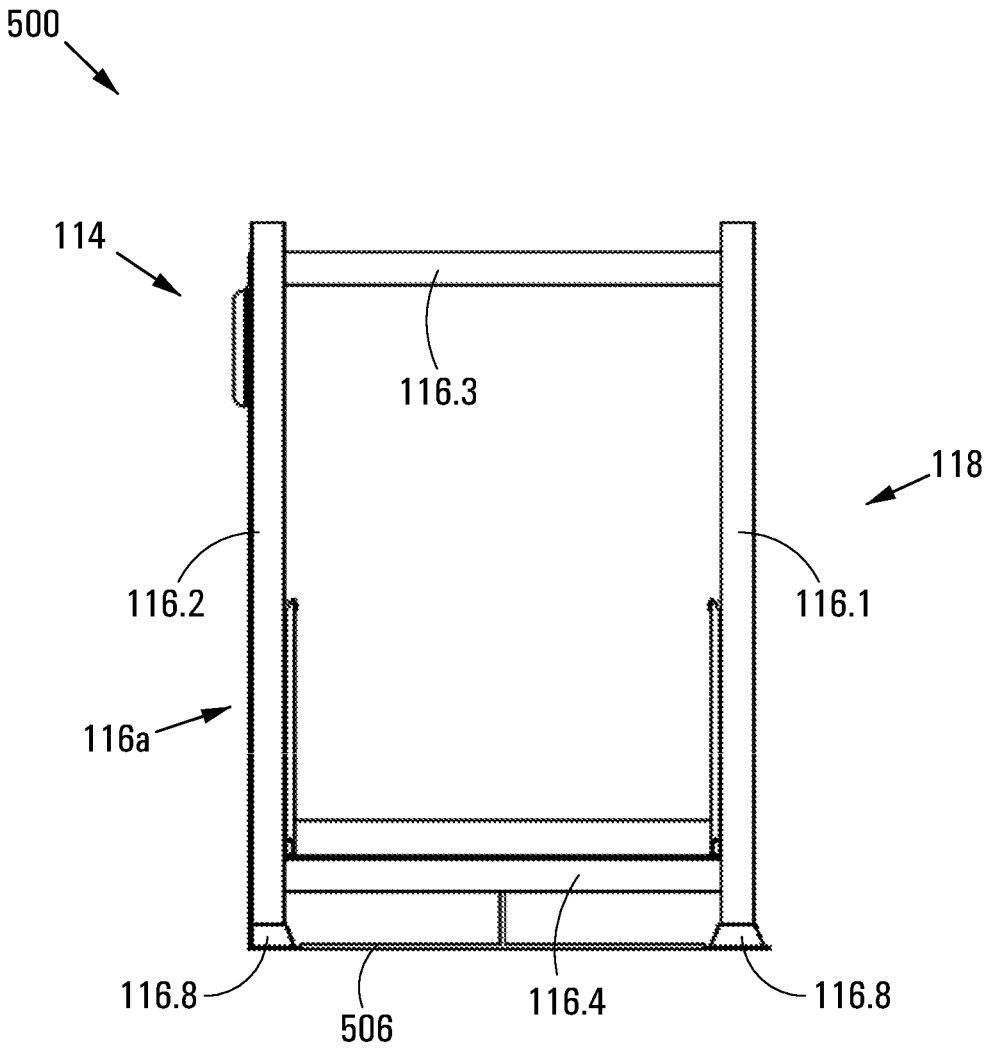
FIG. 21 shows an end view of the container of FIG. 20.
Figure 22:
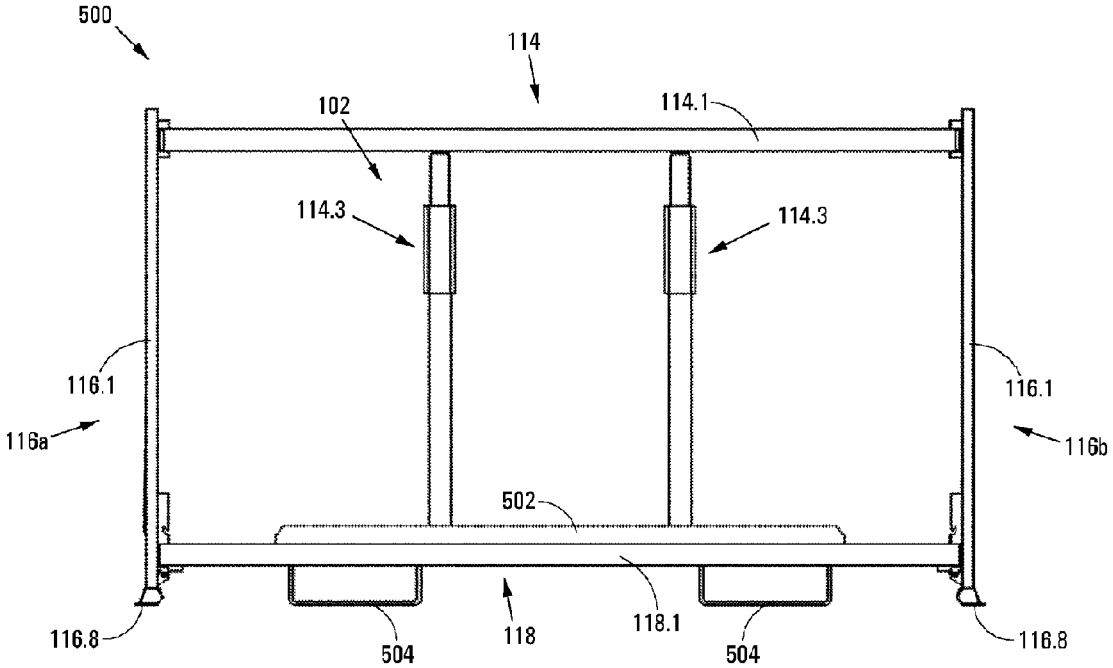
FIG. 22 shows a front view of the container of FIG. 20.
Figure 23:
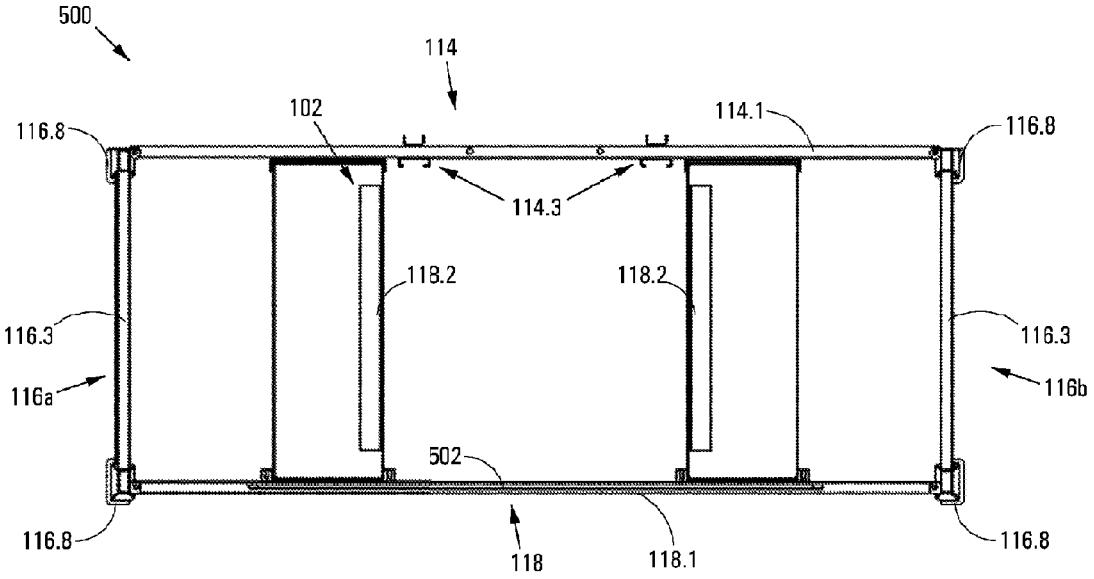
FIG. 23 shows a top view of the container of FIG. 20.

Once the collapsed containers 400 have been packed, a collapsed container 400 is connected between the open ends 114 to serve as a temporary front during transport/handling of the packed container 400 as shown in FIG. 19.

Reference is now made to FIGS. 21 to 26, in which reference numeral 500 refers generally to yet another container in accordance with the invention. Unless otherwise indicated, the same reference numerals used above are used to designate similar parts.

The container 500 is similar to the container 100.

One major difference between the container 500 and the container 100, is that in the case of the container 500, no front side is provided such that the container consists of the rear side 114, the ends 116 and the base 118. A lip 502 protrudes upwardly from the cross member 118.1 when the container is in its erect condition and serves to retain goods contained within the container in position.

In addition, two pairs of rigid staple-shaped formations 504 are connected to and protrude downwardly respectively from the bottom member 114.2 and the cross-member 118.1. The formations 504 serve to receive the tines of a forklift. Lower surfaces of the formations 504 are coplanar with lower surfaces of the feet 116.8 such that, in the erect condition of the container, it is supported on the feet 116.8 and the formations 504. The bracing members 118.2 are pivotally connected directly to the bottom member 114.2 and the cross-member 118.1. The bracing members 118.2 form an elevated support surface on which goods contained within the container are supported at an elevation above the surface on which the container is supported to enable the tines of a forklift to pass therebelow and thereby pick up the container 500. Generally T-shaped guide members are connected to the bottom members 116.4 and serve as guides for the tines of a forklift.

With the exception of the front side 112, the container 500 is displaced between its erect and collapsed conditions in a manner similar to that described above with reference to the container 100.

Figure 24:
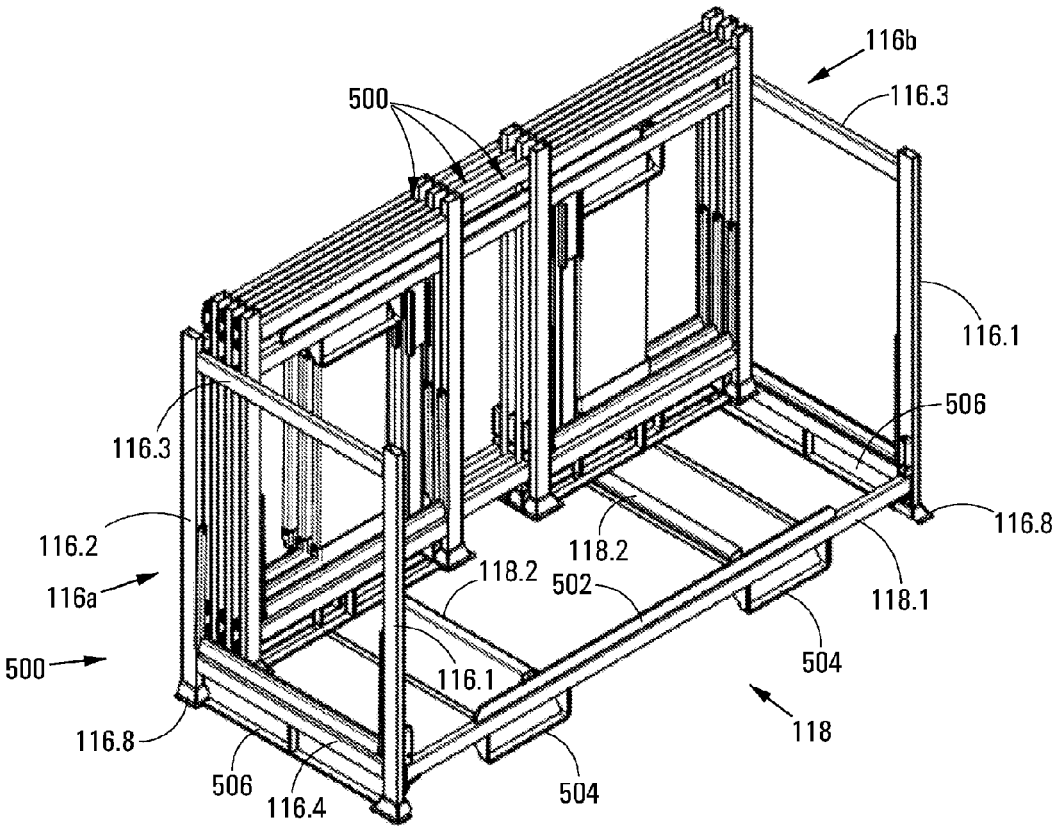
FIG. 24 shows a three-dimensional view, similar to FIG. 20, with a plurality of containers in the collapsed condition packed in a container in its erect condition.
Figure 25:
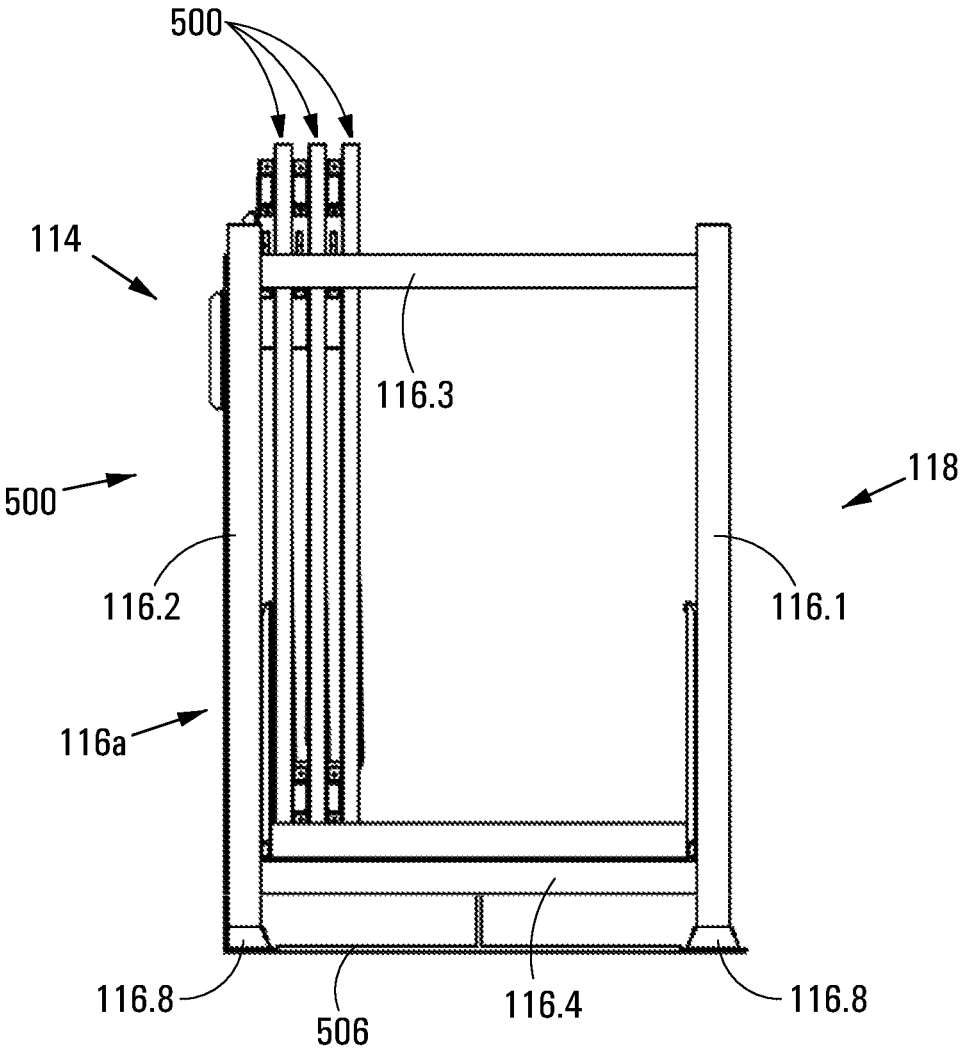
FIG. 25 shows an end view of the container of FIG. 24.
Figure 26:
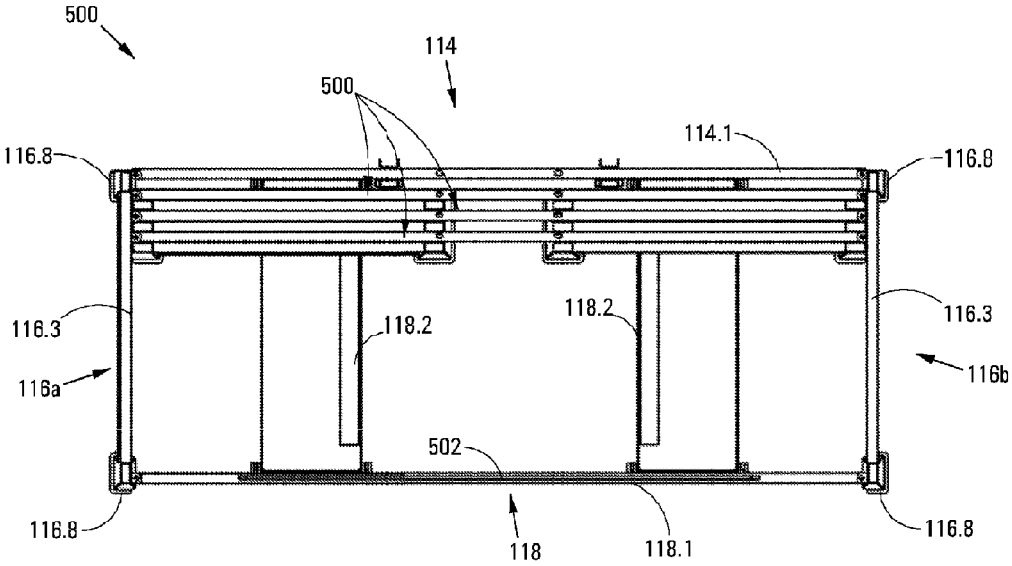
FIG. 26 shows a top view of the container of FIG. 24.
Figure 27:
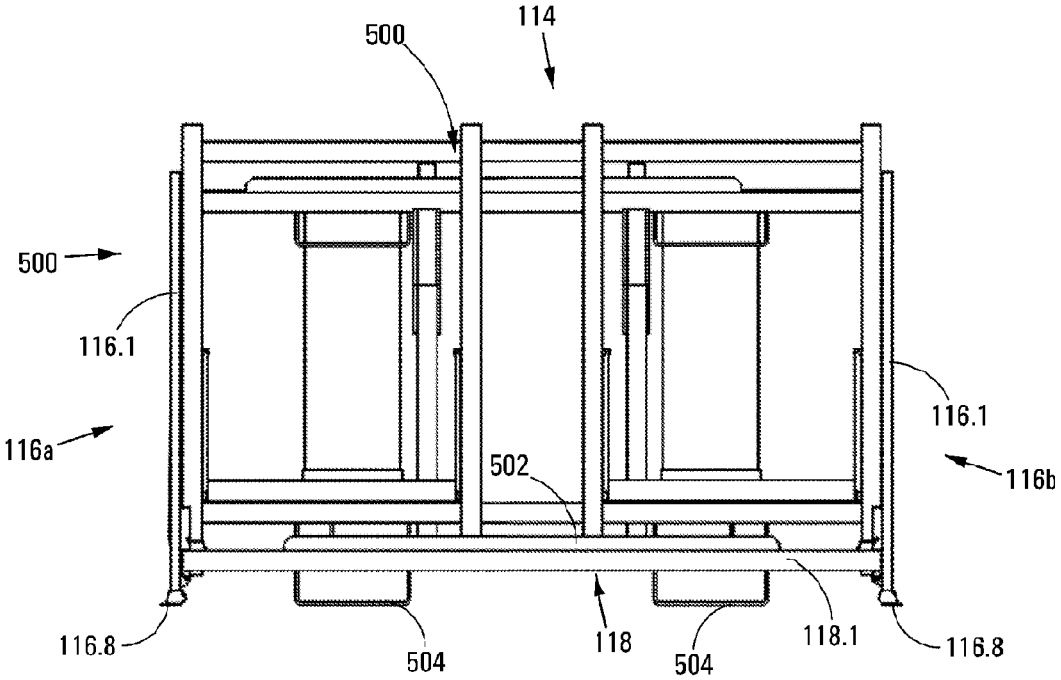
FIG. 27 shows a front view of the container of FIG. 24.

However, as can best be seen in FIGS. 24 and 25, when the collapsed containers are positioned in the erect container 500, they rest on the bracing members 118.2 and they protrude upwardly beyond the top of the erect container 500. The collapsed containers are secured to the erect container by suitable strapping. It will be appreciated that the extent to which the collapsed containers protrude above the top of the container 500 will not be greater than the spacing between the plane defined by the feet 116.8 and the lower surfaces of the formations 504 and the under-surface of the bracing elements 118.2 such that when a plurality of the containers is stacked one on top of the other, the protruding portions of the collapsed containers contained within one of the containers is receivable into the space defined below the bracing formations 118.2 of the container 500 immediately above it.

The inventor believes that the invention as hereinbefore described will provide a cost effective way to transport goods as the container in accordance with the invention can be returned in a collapsed condition within similar erect containers for re-use, thereby saving space and therefore money associated with returning such containers or destroying containers at their destination. The Inventor further believes that where cladding is provided between the frame members of the container particulate material may also be transported within the load space of the container.

I claim:

1. A container which has an erect condition in which it defines a load space within which goods to be transported are receivable and a collapsed condition, the container comprising:

a first side;

a pair of ends which, in the erect condition of the container, are parallel to each other and perpendicular to the first side; and a base which, in the erect condition of the container, is at the bottom thereof; and wherein the base and the ends are hingedly connected to the first side for displacement between the erect condition and the collapsed condition in which they are releasably lockable, displacement of the container from its erect condition to its collapsed condition being effected by displacing the base towards the first side prior to displacing the ends towards the first side, the first side including an elongate top member having opposed top member ends, wherein the ends are hingedly connected to the top member ends, the base including an elongate horizontal cross-member which, in the erect condition of the container, is disconnectably connected to the ends, the base being configured such that when displaced to its collapsed condition, the top member and the base is parallel with and nested at least partially within the first side.

2. The container of claim 1, wherein the side and the base each have a length which is less than a length (P) of the load space, the ends being connected to the side by mounting brackets which are configured such that when the ends are displaced to their collapsed conditions, the overall horizontal length (L) of the container is reduced so that the container, in its collapsed condition, has a length (R) which is less than the length (P) thereby permitting a plurality of the containers to be received and transported, when in their collapsed condition, in the load space of an erect container.

3. The container of claim 1, further comprising a second side which, in the erect condition of the container, is parallel with the first side and perpendicular to and disconnectably connected to the ends.

4. The container of claim 3, further comprising a lid hingedly connected to one of the first or second sides such that it is pivotally foldable relative to the one of the first or second sides, the one of the first or second sides including an elongate top member to which the lid is hingedly connected along an axis parallel to the top member of the one of the first or second sides.

5. The container of claim 4, wherein the sides, ends, base and lid are constructed of sheet material and are configured such that the container forms a box-shaped structure when in the erect condition.

6. The container of claim 3, wherein in order to displace the base from its erect condition to its collapsed condition it is folded concertina-fashion to the first side.

7. The container of claim 3, wherein the container has a partially collapsed container condition in which the second side is displaced relative to the ends and in which another collapsed container is attachable to the ends of the partially collapsed container in place of said side thereby to define an enclosure for receiving a plurality of said containers in their collapsed condition.

8. The container of claim 3, wherein each end comprises at least one clip arrangement which, in the erect condition of the container, engages releasably with one of the base or the second side to retain the container releasably in its erect condition and in the collapsed condition of the container engages releasably with the first side to retain the container releasably in its collapsed condition.

9. The container of claim 8, wherein the first side comprises a bottom member parallel to the top member and a pair of parallel connecting members, connected to the top member and bottom member, each end including elongate parallel side members, connected to and extending between parallel top and bottom members, each side member comprising two mounting brackets mounted respectively on a top and bottom thereof which are pivotally connected to complementary flanges at respective ends of the top and bottom members such that when the ends are displaced to their collapsed conditions, the overall horizontal length of the container is reduced by the depth of the side members and at least part of the length of the mounting brackets thereby permitting the collapsed container to be receivable in the load space of an erect container.

10. The container of claim 1, wherein the base comprises locating arrangements configured to receive tines or prongs of a fork-lift to facilitate handling of the container.

11. The container of claim 1, wherein the base has a length which is not greater than the length of the load space.

12. The container of claim 1, the container further comprising a mounting or bracing arrangement configured to secure goods within the load space and thereby prevent unnecessary movement thereof, the mounting or bracing arrangement being collapsible such that, in use, when the container is in its collapsed condition, the mounting or bracing arrangement has a collapsed condition receivable or nestable in the container in the collapsed condition.

13. The container of claim 1, further comprising support formations configured to provide a support or support surface for collapsed containers packed in the container.

14. A container which has an erect condition in which it defines a load space within which goods to be transported are receivable and a collapsed condition, the container comprising:

at least one first side;

a pair of ends which, in the erect condition of the container, are parallel to each other and perpendicular to the first side; and a base which, in the erect condition of the container, is at the bottom thereof; and wherein, the base and the ends are hingedly connected to the first side for displacement between the erect condition and the collapsed condition in which they are releasably lockable, displacement of the container from its erect condition to its collapsed condition being effected by displacing the base towards the first side prior to displacing the ends towards the first side;

a second side which, in the erect condition of the container, is parallel with the first side and perpendicular to and disconnectably connected to the ends;

wherein each end comprises at least one clip arrangement which, in the erect condition of the container, engages releasably with one of the base or the second side to retain the container releasably in its erect condition and in the collapsed condition of the container engages releasably with the first side to retain the container releasably in its collapsed condition;

wherein the first side comprises parallel top and bottom members and a pair of parallel connecting members, connected to the top member and bottom member, each end including elongate parallel side members, connected to and extending between parallel top and bottom members, each side member comprising two mounting brackets mounted respectively on a top and bottom thereof which are pivotally connected to complementary flanges at respective ends of the top and bottom members such that when the ends are displaced to their collapsed conditions, the overall horizontal length of the container is reduced by the depth of the side members and at least part of the length of the mounting brackets thereby permitting the collapsed container to be receivable in the load space of an erect container;

wherein the base comprises two parallel bracing members, each bracing member being hingedly connected to the cross-member by a plate and being hingedly connected to a back plate which is hingedly connected to the bottom member of the first side, the base being configured such that when displaced to its collapsed condition, the top member abuts against shoulders on the connecting members.

15. The container of claim 14, wherein the second side comprises an elongate top member and a pair of parallel elongate vertical members attached at their upper ends to the top member and extending downwardly therefrom when the container is in its erect condition, the ends of the top member being disconnectedly connected, when the container is in its erect condition, to the ends and the lower ends of the vertical members being disconnectably connected to the base, and in the collapsed condition of the container the side is positioned nested-fashion into the first side such that the top member of the second side lies between and is in register with the top member and the cross-member of the base and that when in their collapsed conditions the members of one container can nest in the side members of an adjacent container.

16. The container of claim 15, wherein the lengths of the ends as well as the widths of the side members are not greater than half the length of any of the top or bottom members of the first or second sides.

17. The container of claim 16, wherein the length of each end is equal to a length measured from the end of the top member of the first or second side to the closest vertical member thereof.

* * * * *